US011338956B2

(12) United States Patent
Ridgeway et al.

(10) Patent No.: US 11,338,956 B2
(45) Date of Patent: May 24, 2022

(54) RETENTION PACKAGING ASSEMBLY

(71) Applicant: Sealed Air Corporation (US), Charlotte, NC (US)

(72) Inventors: Devin Ridgeway, Chula Vista, CA (US); Guillermo Velasco, San Ysidro, CA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/268,978

(22) PCT Filed: Aug. 15, 2019

(86) PCT No.: PCT/US2019/046599

§ 371 (c)(1),
(2) Date: Feb. 17, 2021

(87) PCT Pub. No.: WO2020/037096

PCT Pub. Date: Feb. 20, 2020

(65) Prior Publication Data

US 2021/0245918 A1 Aug. 12, 2021

Related U.S. Application Data

(60) Provisional application No. 62/765,089, filed on Aug. 17, 2018.

(51) Int. Cl.

| | |
|---|---|
| ***B65D 81/07*** | (2006.01) |
| ***B65D 5/50*** | (2006.01) |
| ***B65D 85/68*** | (2006.01) |

(52) U.S. Cl.
CPC ..... *B65D 5/5028* (2013.01); *B65D 85/68* (2013.01); *B65D 2585/6837* (2013.01)

(58) Field of Classification Search
CPC .... B65D 5/5028; B65D 81/07; B65D 81/075; B65D 85/48; B65D 85/68; B65D 2585/6837

(Continued)

(56) References Cited

U.S. PATENT DOCUMENTS 4,852,743 A 8/1989 Ridgeway
4,923,065 A 5/1990 Ridgeway (Continued)

FOREIGN PATENT DOCUMENTS

WO 2015152950 A1 10/2015
WO 2016069893 A1 5/2016

(Continued)

*Primary Examiner* — Luan K Bui
(74) *Attorney, Agent, or Firm* — Jon M. Isaacson

(57) ABSTRACT

A retention packaging assembly (100, 200, 300, 400) includes a frame (100) and sheet assemblies (200, 300). The frame includes a central panel (102), end panels (104), and two sets of wing panels (108, 110). Each set of wing panels includes wing panels foldably coupled to the central panel and to one of the two end panels. The sheet assemblies include a sheet (208) that is attached at its ends to slot panels (204, 206, 304, 306). The slot panels of each of the sheet assemblies are selectively couplable to one of the set of wing panels. After an object is placed on a front of the central panel, the sheets of the sheet assemblies are located over the sides of the object. The sets of wing panels can then be folded to a back of the frame to cause the sheets to retain the sides of the object to the central panel.

18 Claims, 15 Drawing Sheets

(58) Field of Classification Search
USPC ..... 206/320, 521, 453, 583, 586, 591–592, 206/594
See application file for complete search history.

(56) References Cited

U.S. PATENT DOCUMENTS

| | | | | |
|---|---|---|---|---|
| 5,071,009 | A | 12/1991 | Ridgeway | |
| 5,287,968 | A | 2/1994 | Ridgeway | |
| 5,388,701 | A | 2/1995 | Ridgeway | |
| 5,678,695 | A | 10/1997 | Ridgeway et al. | |
| 5,694,744 | A | 12/1997 | Jones | |
| 5,893,462 | A | 4/1999 | Ridgeway | |
| 5,894,932 | A | 4/1999 | Harding et al. | |
| 6,010,006 | A | 1/2000 | Ridgeway et al. | |
| 6,073,761 | A * | 6/2000 | Jones | B65D 5/5028 206/223 |
| 6,148,590 | A | 11/2000 | Ridgeway et al. | |
| 6,148,591 | A | 11/2000 | Ridgeway et al. | |
| 6,289,655 | B1 | 9/2001 | Ridgeway et al. | |
| 6,302,274 | B1 | 10/2001 | Ridgeway | |
| 6,308,828 | B1 * | 10/2001 | Jones | B65D 73/0078 206/223 |
| 6,311,844 | B1 | 11/2001 | Ridgeway et al. | |
| 6,913,147 | B2 | 7/2005 | Mueller et al. | |
| 8,727,123 | B1 * | 5/2014 | Roberts | B65D 81/075 206/583 |
| 9,828,160 | B2 | 11/2017 | Ridgeway | |
| 2004/0108239 | A1 | 6/2004 | McDonald et al. | |
| 2004/0188309 | A1 * | 9/2004 | Kudou | B65D 5/5028 206/521 |
| 2008/0223750 | A1 | 9/2008 | McDonald et al. | |
| 2013/0308255 | A1 | 11/2013 | Sasaki et al. | |
| 2014/0246352 | A1 * | 9/2014 | Roberts | B65D 81/075 206/583 |
| 2017/0247163 | A1 * | 8/2017 | Ridgeway | B65B 5/04 |

FOREIGN PATENT DOCUMENTS

| | | | |
|---|---|---|---|
| WO | 2017134501 | A1 | 8/2017 |
| WO | 2019018229 | A1 | 1/2019 |

* cited by examiner

RETENTION PACKAGING ASSEMBLY

BACKGROUND

The present disclosure is in the technical field of protective packaging. More particularly, the present disclosure is directed to retention packaging.

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "retention packaging." In typical retention packaging, a product is retained between a sheet and a rigid backing frame, which is sometimes the frame to which the sheet is attached. Another type of packaging system is known as suspension packaging. In typical suspension packaging, the packaged product is suspended between two sheets each attached to opposing frames sized to fit within a corresponding box. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, and in U.S. patent application Ser. No. 14/782,208, each of which is incorporated herein in its entirety by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, a retention packaging assembly includes a frame, a first sheet assembly, and a second sheet assembly. The frame includes a central panel, a first end panel foldably coupled to the central panel, a second end panel foldably coupled to the central panel, a first set of wing panels, a second set of wing panels, a first sheet assembly, and a second sheet assembly. Each of the first set of wing panels is foldably coupled to the central panel and to the first end panel. Each of the second set of wing panels is foldably coupled to the central panel and to the second end panel. The first sheet assembly includes first slot panels and a first sheet. Ends of the first sheet are attached to the first slot panels. The first sheet spans between the first slot panels. Each of the first slot panels is selectively couplable to one of the first set of wing panels. The second sheet assembly includes second slot panels and a second sheet. Ends of the second sheet are attached to the second slot panels. The second sheet spans between the second slot panels. Each of the second slot panels is selectively couplable to one of the second set of wing panels. After the first slot panels are coupled to the first set of wing panels, the second slot panels are coupled to the second set of wing panels, and an object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel. The first and second end panels are configured to be folded into a folded configuration. The frame further includes a first securing mechanism configured to hold the first end panel in the folded configuration with respect to the central panel and a second securing mechanism configured to hold the second end panel in the folded configuration with respect to the central panel.

In a second embodiment, each of the first set of wing panels of the first embodiment includes a tab. Each of the first slot panels includes a first slot. The first slot panels are selectively couplable to the first set of wing panels by inserting the tabs of the first set of wing panels through the first slots of the first slot panels.

In a third embodiment, each of the first slot panels of the second embodiment includes a first section that includes the first slot and a second section that includes a second slot. Each of the first slot panels is configured to be folded to place the first and second sections in an overlapping orientation. Each of the tabs of the first set of wing panels is configured to be inserted through both of the first and second slots of one of the first slot panels.

In a fourth embodiment, when one of the first slot panels of the third embodiment is folded with the first and second sections in the overlapping orientation, the first and second slots are in an offset position.

In a fifth embodiment, each of the second set of wing panels of any of the second to fourth embodiments includes a tab. Each of the second slot panels includes a slot. The second slot panels are selectively couplable to the second set of wing panels by inserting the tabs of the second set of wing panels through the slots of the second slot panels.

In a sixth embodiment, the first end panel of any of the preceding embodiments is configured to be folded into the folded configuration after the first set of wing panels are folded to the back of the frame. The second end panel is configured to be folded into the folded configuration after the second set of wing panels are folded to the back of the frame.

In a seventh embodiment, each of the first and second end panels of the sixth embodiment includes a first section and second section. When the first end panel is in the folded configuration, the first and second sections of the first end panel extend away from the front of the central panel. When the second end panel is in the folded configuration, the first and second sections of the first end panel extend away from the front of the central panel.

In an eighth embodiment, when the first end panel of the seventh embodiment is in the folded configuration, the first and second sections of the first end panel extend away from the front of the central panel a distance that is further than the object extends away from the central panel. When the second end panel is in the folded configuration, the first and second sections of the second end panel extend away from the front of the central panel a distance that is further than the object extends away from the central panel.

In a ninth embodiment, each of the first and second end panels of any of the seventh or eighth embodiments further includes a third section. When the first end panel is in the folded configuration, the third section of the first end panel is substantially parallel with the central panel. When the second end panel is in the folded configuration, the third section of the second end panel is substantially parallel with the central panel.

In a tenth embodiment, the second section of the first end panel of any of the seventh to ninth embodiments includes a first slot and the second section of the second end panel includes a second slot. The first securing mechanism is a first dovetail tab foldably coupled to the central panel and the second securing mechanism is a second dovetail tab foldably coupled to the central panel.

In an eleventh embodiment, the first dovetail tab of the tenth embodiment is configured to be secured to the first slot to hold the second section of the first end panel with respect to the central panel. The second dovetail tab is configured to be secured to the second slot to hold the second section of the second end panel with respect to the central panel.

In a twelfth embodiment, the frame of any of the preceding embodiments further includes a first handle panel foldably coupled to a top of the central panel.

In a thirteenth embodiment, the first handle panel of the twelfth embodiment includes one or more slots configured to accommodate a hand of a user to enable the user to lift the retention packaging assembly.

In a fourteenth embodiment, the first handle panel of any of the twelfth or thirteenth embodiments extends between the first and second sheets when the first and second sheets retain the first and second sides of the object to the central panel. The first handle panel is substantially centered between the first and second end panels.

In a fifteenth embodiment, the first sheet assembly of any of the preceding embodiments includes a first side panel that is fixed to a longitudinal side of the first sheet and extends beyond the longitudinal side of the first sheet. The second sheet assembly includes a second side panel that is fixed to a longitudinal side of the second sheet and extends beyond the longitudinal side of the second sheet.

In a sixteenth embodiment, the first side panel of the fifteenth embodiment is configured to be folded around a first lateral side of the object after the first set of wing panels are folded to the back of the frame. The second side panel is configured to be folded around a second lateral side of the object after the second set of wing panels are folded to the back of the frame.

In a seventeenth embodiment, when the first side panel of the sixteenth embodiment is folded around the first lateral side of the object, a portion of the first side panel that is not fixed to the first sheet is between the central panel and the object. When the second side panel is folded around the second lateral side of the object, a portion of the second side panel that is not fixed to the second sheet is between the central panel and the object.

In an eighteenth embodiment, the object of any of the preceding embodiments is a flat-screen television.

In a nineteenth embodiment, a system includes the retention packaging assembly of any of the preceding embodiments, an object configured to be retained to the central panel of the frame of the retention packaging assembly by the first and second sheets, and a container. The retention packaging assembly is configured to be placed inside the container when the object is retained to the central panel by the first and second sheets.

In a twentieth embodiment, the system of nineteenth embodiment further includes at least one peripheral container configured to hold one or more peripheral items.

In a twenty first embodiment, the peripheral container of the twentieth embodiment is formed from a container portion removed from one of the first and second sheet assemblies.

In a twenty second embodiment, the frame of the retention packaging assembly of any of the twentieth or twenty first embodiments further includes a handle panel foldably coupled to a top of the central panel.

In a twenty third embodiment, the at least one peripheral container of the twenty second embodiment includes a slot, and wherein the at least one peripheral container is placed in the container with a portion of the central panel inserted into the slot of the at least one peripheral container. The at least one peripheral container is located below a fold line between the central panel and the handle panel.

In a twenty fourth embodiment, the handle panel of the twenty third embodiment is configured to be folded with respect to the central panel about the fold line so that a portion of the handle panel covers an end of the at least one peripheral container.

In a twenty fifth embodiment, when the handle panel of the twenty fourth embodiment is folded with respect to the central panel about the fold line, the handle panel extends across an opening of the container.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1A:
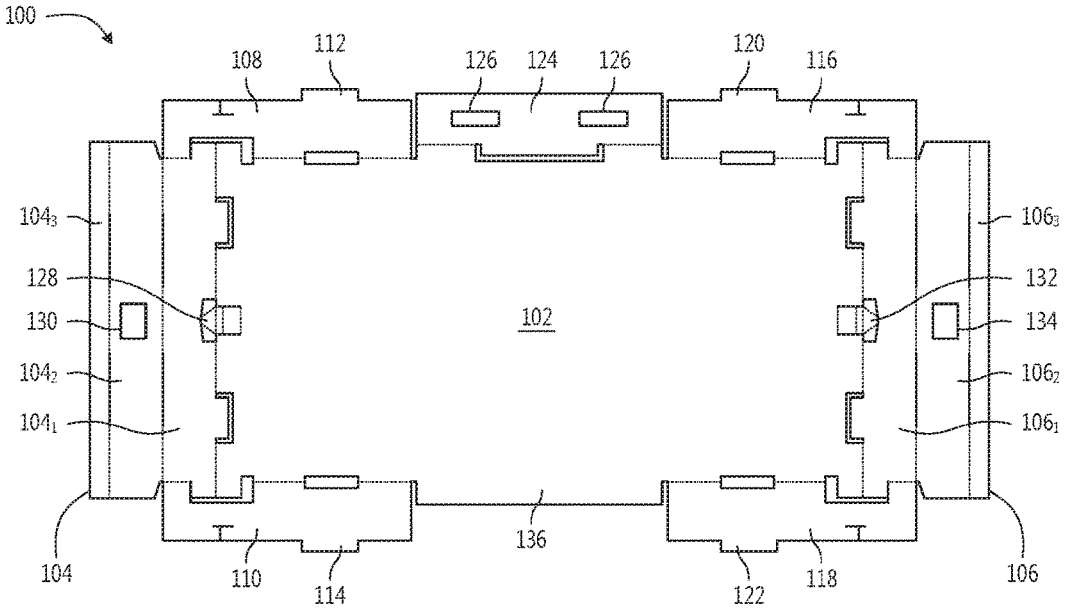
FIGS. 1A, 1B, and 1C depict, respectively, embodiments of a frame, a first sheet assembly, and a second sheet assembly that can be formed into a retention packaging assembly for packaging an object, in accordance with the embodiments disclosed herein.

The present disclosure describes embodiments of retention packaging assemblies. In particular, the embodiments disclosed herein are directed to embodiments of retention packaging assemblies for large objects, such as flat screen televisions. It will be noted that, while the embodiments disclosed herein use flat screen televisions as an exemplary object for packaging in the retention packaging assemblies, any other object could be packaged in the retention packaging assemblies. For example, the retention packaging assemblies described herein could also be used to package computer monitors, picture frames, works of art (e.g., paintings and portraits), display cases, plaques, signs, computers, other electronics, white boards, chalk boards, building materials (e.g., wall paneling), or any other objects.

Various embodiments of retention package assemblies described herein utilize a combination of at least one frame and at least one sheet. In some embodiments, a frame, or any portion thereof, comprises a substantially rigid, lightweight, foldable material. In some examples, a frame, or any portions of the frame, are formed of one or more of the following materials: cellulosic-based materials (e.g., cardboard, corrugated cardboard, paperboard), plastic, and compressed foam. In one example, a frame may comprise corrugated cardboard, such as any of single-wall B-flute, C-flute, and/or E-flute corrugated cardboard, B/C double-wall corrugated cardboard, E/B double-wall corrugated cardboard, or any combination thereof. In some embodiments, a frame has a predetermined average thickness. In some examples, the average thickness of the frame may be at most about, and/or at least about, any of the following thicknesses: 0.03, 0.06, 0.12, 0.18, 0.25, 0.3, 0.4, and 0.5 inches.

In some cases, a frame, or any portion thereof, may be configured to be folded. In some embodiments, a fold line is located between two panels and the two panels are configured to be folded with respect to each other along the fold line. A "fold line," as used herein, represents a line along which a panel, frame, or other material has been creased, crimped, embossed, perforated, scored, or otherwise weakened so as to enhance the foldability of the panel, frame, or other material along the fold line. In some embodiments, a fold line may permit two panels on either side of the fold line to be folded at any angle less than 180° (i.e., less than an unfolded ("lay-flat") configuration of the panels) including, but not limited to, an angle of approximately 90°.

Sheets used in combination with frames may be used to retain objects against the frames. Any of the sheets in the various embodiments described herein (collectively, "the sheets") may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

In some embodiments, the sheet has a composition and thickness providing acceptable performance properties (e.g., flexibility, elasticity, optics, strength) for the given packaging application of expected use. In some examples, the sheets have a thickness of at most any of the following: 10 mils, 6 mils, 5 mils, 4 mils, 3 mils, 2 mils, 1.5 mils, and 1 mil. (A "mil" is equal to 0.001 inch.) In some examples, the sheets have a thickness of at least any of the following: 0.5 mils, 1 mil, 1.5 mils, 2 mils, and 3 mils.

In some embodiments, the sheets have an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

In some embodiments, the sheets have a maximum load tear resistance in either or both of the transverse and longitudinal directions of at least any of the following values: 400, 450, 500, 550, and 600 grams force, measured according to ASTM D1004.

In some embodiments, the sheets have a slow puncture maximum load of at least any of the following values: 4, 4.5, 5, 5.5, 6, 6.5, and 7 pounds force, measured according to ASTM F1306 using a crosshead speed of 5 inches per minute.

In some embodiments, the sheets have a Young's modulus sufficient to withstand the expected handling and use conditions, yet may provide a "soft" feel that may be desirable for a packaging application. The sheets may have a Young's modulus of at least any of the following values: 2,000; 2,500; 3,000; 3,500; and 4,000 pounds/square inch. The sheets may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

In some embodiments, the sheets are transparent so that a packaged article is visible through the sheet. As used herein, "transparent" means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

In some embodiments, the sheets have a heat-shrink attribute. In some examples, the sheets have any one of: a free shrink in at least one direction (i.e., machine or transverse directions), a free shrink in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. In other embodiments, the sheets are non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

In some embodiments, the sheets include one or more fabrics. For example, in some embodiments, the sheets include one or more of the following: wovens, knits, non-wovens, and openwork meshes (e.g., netting), spandex, including Lycra® brand spandex, and elastic fabrics.

In some embodiments, the sheets include one or more polymers. In some examples, the sheets include one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). In some embodiments, the sheets include thermoplastic polyolefin elastomers (TPOs), which are two-component elastomer systems comprising an elastomer (such as EPDM) finely dispersed in a thermoplastic polyolefin (such as polypropylene or polyethylene). As used in this application, "copolymer" means a polymer derived from two or more types of monomers, and includes terpolymers, etc.

In some embodiments, the sheets include polyolefin (e.g., polyethylene), polyvinyl chloride, and/or polyurethane. In some examples, such embodiments of the sheets have a thickness of from 2 to 4 mils. Such embodiments of the sheets may be useful for lightweight applications. In some examples, the sheets that include polyurethane may provide desirable elastomeric, puncture resistance, temperature resistance, and tackiness characteristics.

In some embodiments, the sheets include effective amounts of one or more of tackifiers, antiblocking agents, and slip agents—or may be essentially free of any of these components. Tackifiers, antiblocking agents, and slip agents, and their effective amounts, are known to those of ordinary skill in the art.

In some embodiments, the sheets are manufactured by thermoplastic film-forming processes known in the art (e.g., tubular or blown-film extrusion, coextrusion, extrusion coating, flat or cast film extrusion). In some embodiments, a combination of these processes is also employed to manufacture the sheets.

In some embodiments, at least one side of the sheets is corona and/or plasma treated to change the surface energy of the sheets. In one example, the change in surface energy increases the ability of the sheets to adhere to a panel or frame.

Films that may be useful as the sheets are described in U.S. Pat. No. 6,913,147, issued Jul. 5, 2005, and entitled "Packaging Structure Having a Frame and Film," which is incorporated herein in its entirety by reference.

By using types of machinery well known to those of skill in the field, frames may be cut to the desired shapes and provided with fold lines or lines of detachability, using the known types of machinery, for example, to slit, crease, crimp, emboss, perforate, scored, or otherwise weaken the panel in desired regions. In some embodiments, films may be adhered to frames in one or more selected areas. In some embodiments, the sheets are attached to frames by laminating or adhering the sheets with adhesive to the frames. In some embodiments, the material of the sheets is provided in roll form or unrolled form, and then cut to the desired length and width either before or after attachment to the frames.

In some examples, descriptions herein of attaching a sheet to a frame and/or a frame to a frame may include attaching using an adhesive. However, in other embodiments, attaching a sheet to a frame and/or a frame to a frame may be accomplished by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein. Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

Figure 1B:
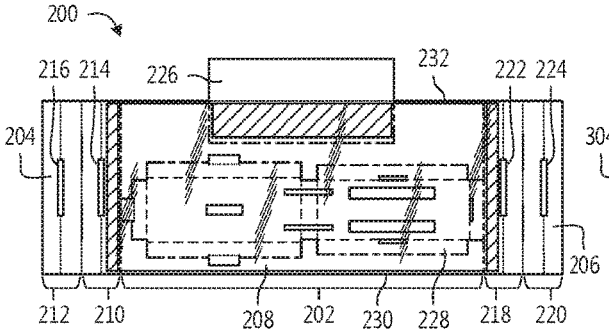
Figure 1C:
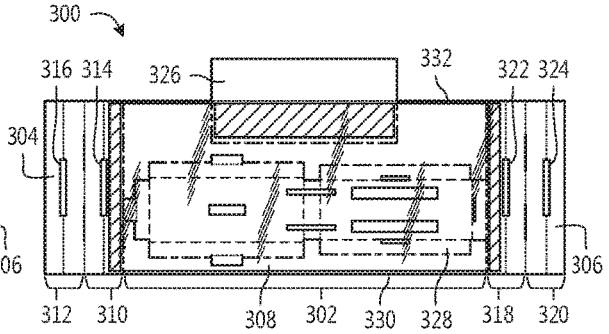

Depicted in FIGS. 1A, 1B, and 1C, respectively, are embodiments of a frame 100, a sheet assembly 200, and a sheet assembly 300 that can be formed into a retention packaging assembly for packaging an object, such as a flat-screen television. In FIG. 1A, the frame 100 includes a central panel 102. In the depicted embodiment, the central panel 102 is substantially centered on the frame 100. In other embodiments, the central panel 102 may be off-centered in one or more directions of the frame 100.

The frame 100 also includes an end panel 104 that is rotatably coupled to the central panel 102 by fold lines. In the depicted embodiment, the end panel 104 has a first section $\mathbf{104}_1$, a second section $\mathbf{104}_2$, and a third section $\mathbf{104}_3$. In the depicted embodiment, the first section $\mathbf{104}_1$ of the end panel 104 is located between (i) the fold lines between the central panel 102 and the end panel 104 and (ii) the fold lines between the first section $\mathbf{104}_1$ and the second section $\mathbf{104}_2$; the second section $\mathbf{104}_2$ of the end panel 104 is located between (i) the fold lines between the first section $104_1$ and the second section $104_2$ and (ii) the fold lines between the second section $104_2$ and the third section $104_3$; and the third section $104_3$ of the end panel 104 is located between (i) the fold lines between the second section $104_2$ and the third section $104_3$ and (ii) the left end of the frame 100. In the depicted embodiment, the frame 100 includes a combination of crimped lines (dashed lines) and slits (solid lines) between the set of the first and second sections $104_1$ and $104_2$ and between the second and third sections $104_2$ and $104_3$.

The frame 100 also includes an end panel 106 that is rotatably coupled to the central panel 102 by fold lines. In the depicted embodiment, the end panels 104 and 106 are rotatably coupled to opposite ends of the central panel 102. In the depicted embodiment, the end panel 106 has a first section $106_1$, a second section $106_2$, and a third section $106_3$. In the depicted embodiment, the first section $106_1$ of the end panel 106 is located between (i) the fold lines between the central panel 102 and the end panel 106 and (ii) the fold lines between the first section $106_1$ and the second section $106_2$; the second section $106_2$ of the end panel 106 is located between (i) the fold lines between the first section $106_1$ and the second section $106_2$ and (ii) the fold lines between the second section $106_2$ and the third section $106_3$; and the third section $106_3$ of the end panel 106 is located between (i) the fold lines between the second section $106_2$ and the third section $106_3$ and (ii) the left end of the frame 100. In the depicted embodiment, the frame 100 includes a combination of crimped lines (dashed lines) and slits (solid lines) between the set of the first and second sections $106_1$ and $106_2$ and between the second and third sections $106_2$ and $106_3$.

The frame 100 includes a wing panel 108 and a wing panel 110 that form a first set of wing panels. The wing panel 108 is rotatably coupled to each of the central panel 102 and the end panel 104. In the depicted embodiment, the wing panel 108 is rotatably coupled to each of the central panel 102 and the second section $104_2$ of the end panel 104. The wing panel 110 is rotatably coupled to each of the central panel 102 and the end panel 104. In the depicted embodiment, the wing panel 110 is rotatably coupled to each of the central panel 102 and the second section $104_2$ of the end panel 104. In the depicted embodiment, the wing panels 108 and 110 are rotatably coupled to oppose sides of the central panel 102 and the end panel 104. In some embodiments, the wing panels 108 and 110 are couplable to a sheet assembly. In the depicted embodiment, the wing panel 108 includes a tab 112 and the wing panel 110 includes a tab 114, and the tabs 112 and 114 are couplable to a sheet assembly.

The frame 100 also includes a wing panel 116 and a wing panel 118 that form a second set of wing panels. The wing panel 116 is rotatably coupled to each of the central panel 102 and the end panel 104. In the depicted embodiment, the wing panel 116 is rotatably coupled to each of the central panel 102 and the second section $106_2$ of the end panel 106. The wing panel 118 is rotatably coupled to each of the central panel 102 and the end panel 106. In the depicted embodiment, the wing panel 118 is rotatably coupled to each of the central panel 102 and the second section $106_2$ of the end panel 106. In the depicted embodiment, the wing panels 116 and 118 are rotatably coupled to oppose sides of the central panel 102 and the end panel 106. In some embodiments, the wing panels 116 and 118 are couplable to a sheet assembly. In the depicted embodiment, the wing panel 116 includes a tab 120 and the wing panel 118 includes a tab 122, and the tabs 120 and 122 are couplable to a sheet assembly.

The frame 100 also includes a handle panel 124. The handle panel 124 includes slots 126. In some embodiments, the slots 126 are configured to accommodate a hand of a user to enable the user to lift the frame 100 when the frame 100 is formed into a retention packaging assembly. The frame 100 also includes a bottom panel 136. In the depicted embodiment, the bottom panel 136 extends away from a portion of the lower edge of the central panel 102. In addition, in the depicted embodiment, there is no folding line between the bottom panel 136 and the central panel 102 and there is no folding line on the bottom panel 136 itself.

In the depicted embodiment, the frame 100 also includes a dovetail tab 128 that is rotatably coupled to the central panel 102 by a fold line. Aside from the fold line between the dovetail tab 128 and the central panel 102, the rest of the sides of the dovetail tab 128 are cut through the thickness of the frame 100. In this way, the dovetail tab 128 can be removed from the lay-flat configuration by a user manually rotating the dovetail tab 128 from plane of the central panel 102 about the fold line between the central panel 102 and the dovetail tab 128. The frame 100 also includes a slot 130 in the end panel 104. In the depicted embodiment, the slot 130 is in the second section $104_2$ of the end panel 104. In some embodiments, the slot 130 is aligned with the dovetail tab 128 so that the dovetail tab 128 can be secured to the slot 130 to hold the end panel 104 in a folded configuration with respect to the central panel 102. In some embodiments, the dovetail tab 128 includes one or more fold lines to enable the dovetail tab 128 to be inserted into the slot 130 to secure the dovetail tab 128 to the slot 130. An example of the dovetail tab 128 secured to the slot 130 to hold the end panel 104 in a folded configuration with respect to the central panel 102 is described below.

In the depicted embodiment, the frame 100 also includes a dovetail tab 132 that is rotatably coupled to the central panel 102 by a fold line. Aside from the fold line between the dovetail tab 132 and the central panel 102, the rest of the sides of the dovetail tab 132 are cut through the thickness of the frame 100. In this way, the dovetail tab 132 can be removed from the lay-flat configuration by a user manually rotating the dovetail tab 132 from plane of the central panel 102 about the fold line between the central panel 102 and the dovetail tab 132. The frame 100 also includes a slot 134 in the end panel 106. In the depicted embodiment, the slot 134 is in the second section $106_2$ of the end panel 106. In some embodiments, the slot 134 is aligned with the dovetail tab 132 so that the dovetail tab 132 can be secured to the slot 134 to hold the end panel 106 in a folded configuration with respect to the central panel 102. In some embodiments, the dovetail tab 132 includes one or more fold lines to enable the dovetail tab 132 to be inserted into the slot 134 to secure the dovetail tab 132 to the slot 134. An example of the dovetail tab 132 secured to the slot 134 to hold the end panel 106 in a folded configuration with respect to the central panel 102 is described below.

When viewing the frame 100 in FIG. 1A, the side of the frame 100 that is visible may be considered the front of the frame 100. The side that is not visible may be considered the back of the frame 100. Similarly, the front of the central panel 102 is visible in FIG. 1A and the back of the central panel 102 is not visible, and so forth. For convenience, the description below refers to the front and back of the frame 100, the front and back of the central panel 102, etc. in this way. However, it will be apparent that, in other descriptions, the side of the frame 100 that is visible could be considered the back and the side of the frame that is not visible could be considered the front.

Depicted in FIG. 1B is the sheet assembly 200. The sheet assembly 200 includes a frame that has a removable panel 202, a slot panel 204, and a slot panel 206. The frame includes weakened portions (e.g., perforations) shown in short-long dashed lines between the removable panel 202 and each of the slot panels 204 and 206. The sheet assembly further includes a sheet 208 that is fixed to the frame. In the depicted embodiment, the sheet 208 is fixed (e.g., adhered) to each of the slot panels 204 and 206. Each of the slot panels 204 and 206 is selectively couplable to one of the wing panels 108 and 110.

In the depicted embodiment, the slot panel 204 includes a first section 210 and a second section 212. In the depicted embodiment, the first section 210 of the slot panel 204 is located between (i) the weakened portion between the removable panel 202 and the slot panel 204, and (ii) fold lines between the first section 210 and the second section 212; and the second section 212 of the slot panel 204 is located between (i) the fold lines between the first section 210 and the second section 212 and (ii) the left end of the slot panel 204. The slot panel 204 also includes a slot 214 in the first section 210 and a slot 216 in the second section 212. In some embodiments, the slots 214 and 216 are arranged such that one of the tabs 112 and 114 can be inserted through both of the slots 214 and 216. An example of the tab 112 passing through both of the slots 214 and 216 is described below.

In the depicted embodiment, the slot panel 206 includes a first section 218 and a second section 220. In the depicted embodiment, the first section 218 of the slot panel 206 is located between (i) the weakened portion between the removable panel 202 and the slot panel 206, and (ii) fold lines between the first section 218 and the second section 220; and the second section 220 of the slot panel 206 is located between (i) the fold lines between the first section 218 and the second section 220 and (ii) the right end of the slot panel 206. The slot panel 206 also includes a slot 222 in the first section 218 and a slot 224 in the second section 220. In some embodiments, the slots 222 and 224 are arranged such that one of the tabs 112 and 114 can be inserted through both of the slots 222 and 224. An example of the tab 114 passing through both of the slots 222 and 224 is described below.

The frame of the sheet assembly 200 also includes a side panel 226. In some embodiments, the side panel 226 is affixed to the sheet 208 on a longitudinal side of the sheet 208 and the side panel 226 extends beyond the longitudinal side of the sheet 208. The longitudinal side of the sheet 208 is located at the top of the sheet 208 in the depiction shown in FIG. 1B. In some embodiments, the frame includes weakened portions (e.g., perforations) shown in short-long dashed lines between the removable panel 202 and the side panel 226.

In in some embodiments, the removable panel 202 includes a container portion 228. In the depicted embodiment, the container portion 228 is bordered by (i) the weakened portion between the removable panel 202 and the slot panel 204, (ii) a weakened portion between the container portion 228 and a disposable portion 230, (iii) the weakened portion between the removable panel 202 and the slot panel 206, and (iv) a weakened portion between the container portion 228 and a disposable portion 232. As is also shown in the depicted embodiment, the weakened between the removable panel 202 and the side panel 226 is between the disposable portion 232 and the side panel 226.

Depicted in FIG. 1C is the sheet assembly 300. The sheet assembly 300 includes a frame that has a removable panel 302, a slot panel 304, and a slot panel 306. The frame includes weakened portions (e.g., perforations) shown in short-long dashed lines between the removable panel 302 and each of the slot panels 304 and 306. The sheet assembly further includes a sheet 308 that is fixed to the frame. In the depicted embodiment, the sheet 308 is fixed (e.g., adhered) to each of the slot panels 304 and 306. Each of the slot panels 304 and 306 is selectively couplable to one of the wing panels 116 and 118.

In the depicted embodiment, the slot panel 304 includes a first section 310 and a second section 312. In the depicted embodiment, the first section 310 of the slot panel 304 is located between (i) the weakened portion between the removable panel 302 and the slot panel 304, and (ii) fold lines between the first section 310 and the second section 312; and the second section 312 of the slot panel 304 is located between (i) the fold lines between the first section 310 and the second section 312 and (ii) the left end of the slot panel 304. The slot panel 304 also includes a slot 314 in the first section 310 and a slot 316 in the second section 312. In some embodiments, the slots 314 and 316 are arranged such that one of the tabs 120 and 122 can be inserted through both of the slots 314 and 316. An example of the tab 120 passing through both of the slots 314 and 316 is described below.

In the depicted embodiment, the slot panel 306 includes a first section 318 and a second section 320. In the depicted embodiment, the first section 318 of the slot panel 306 is located between (i) the weakened portion between the removable panel 302 and the slot panel 306, and (ii) fold lines between the first section 318 and the second section 320; and the second section 320 of the slot panel 306 is located between (i) the fold lines between the first section 318 and the second section 320 and (ii) the right end of the slot panel 306. The slot panel 306 also includes a slot 322 in the first section 318 and a slot 324 in the second section 320. In some embodiments, the slots 322 and 324 are arranged such that one of the tabs 120 and 122 can be inserted through both of the slots 322 and 324. An example of the tab 122 passing through both of the slots 322 and 324 is described below.

The frame of the sheet assembly 300 also includes a side panel 326. In some embodiments, the side panel 326 is affixed to the sheet 308 on a longitudinal side of the sheet 308 and the side panel 326 extends beyond the longitudinal side of the sheet 308. The longitudinal side of the sheet 308 is located at the top of the sheet 308 in the depiction shown in FIG. 1C. In some embodiments, the frame includes weakened portions (e.g., perforations) shown in short-long dashed lines between the removable panel 302 and the side panel 326.

In in some embodiments, the removable panel 302 includes a container portion 328. In the depicted embodiment, the container portion 328 is bordered by (i) the weakened portion between the removable panel 302 and the slot panel 304, (ii) a weakened portion between the container portion 328 and a disposable portion 330, (iii) the weakened portion between the removable panel 302 and the slot panel 306, and (iv) a weakened portion between the container portion 328 and a disposable portion 332. As is also shown in the depicted embodiment, the weakened between the removable panel 302 and the side panel 326 is between the disposable portion 332 and the side panel 326.

FIGS. 1A, 1B, and 1C depict a first instance of the frame 100, the sheet assembly 200, and the sheet assembly 300 in lay-flat configurations. In the lay-flat configuration, the frame 100 and the sheet assemblies 200 and 300 can be placed substantially flat on a surface, such as a table. From the first instance shown in FIGS. 1A to 1C, the frame 100 and the sheet assemblies 200 and 300 can be used to form a retention packaging assembly around an object and to place the object that is in the retention packaging assembly into a container. An embodiment of using the frame 100 and the sheet assemblies 200 and 300 in this manner is shown in the series of instances shown from FIG. 1A to FIG. 15B.

One embodiment of packaging an object, such as a flat screen television, can be packaged using a retention packaging assembly that includes a frame is depicted in a series of instances shown in FIG. 1A to FIG. 15B. While FIG. 1A to FIG. 15B depict a particular order of steps of a method of packaging a flat screen television, it will be understood that other embodiments of packaging methods may vary the order of the steps shown in FIG. 1A to FIG. 15B, eliminate one or more of the steps shown in FIG. 1A to FIG. 15B, add one or more additional steps not shown in FIG. 1A to FIG. 15B, or otherwise vary the method shown in FIG. 1A to FIG. 15B. In addition, while the embodiment of the retention packaging assembly shown in FIG. 1A to FIG. 15B includes a particular set of features, it will be understood that other embodiments of retention packaging assemblies may vary the features shown in FIG. 1A to FIG. 15B, eliminate one or more of the features shown in FIG. 1A to FIG. 15B, add one or more additional features not shown in FIG. 1A to FIG. 15B, or otherwise vary the features shown in FIG. 1A to FIG. 15B.

Figure 2A:
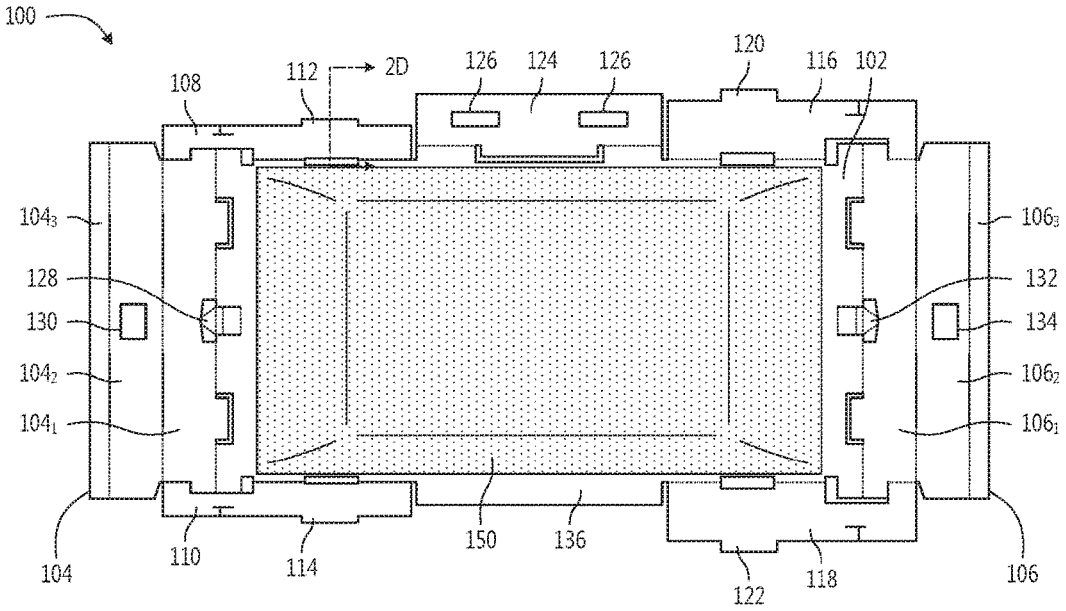
FIGS. 2A, 2B, and 2C depict a second instance of the frame, the first sheet assembly, and the second sheet assembly, in accordance with the embodiments disclosed herein.
Figure 2B:
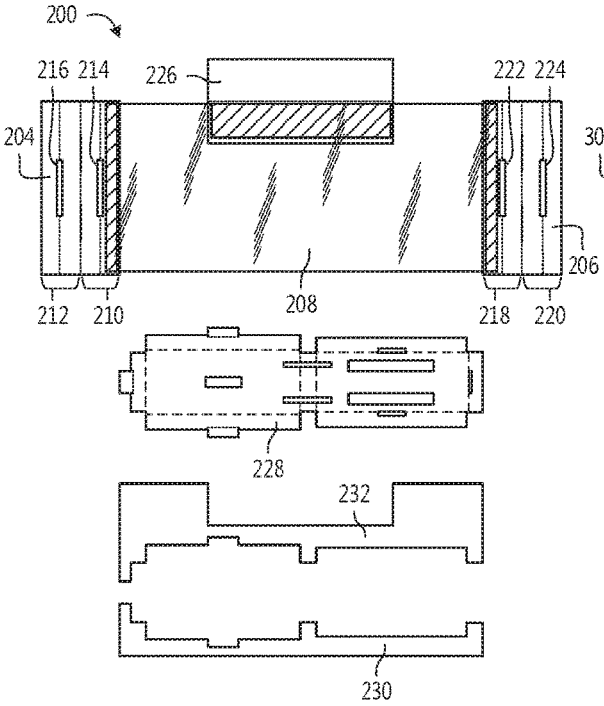
Figure 2C:
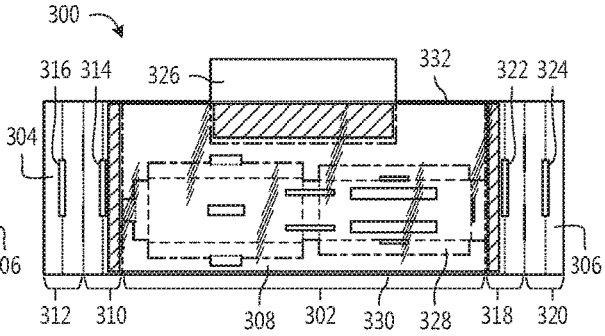
Figure 2D:
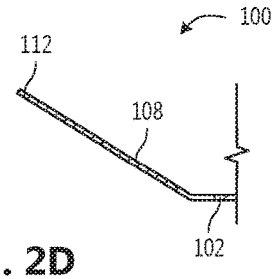
FIG. 2D depicts a cross-sectional partial view of the frame, in accordance with the embodiments disclosed herein.

FIGS. 2A, 2B, and 2C depict a second instance of the frame 100, the sheet assembly 200, and the sheet assembly 300. FIG. 2D depicts a cross-sectional partial view of the frame 100. In FIG. 2A, an object 150 has been placed on the front of the central panel 102 of the frame 100. In the depicted embodiment, the object 150 is a flat-screen television that is placed, screen down, on the front of the central panel 102 of the frame 100. The frame 100 is in the form of corrugated cardboard. In some embodiments, the object 150 may have protective material on it. In one example, the object 150 may be a television that has been covered by a thin foam sheet to provide scratch resistance, surface finish protection, anti-static protection, or any other protection.

As can be seen in FIGS. 2A and 2D, the wing panel 108 has been lifted toward the front of the frame 100. The wing panel 110 has similarly been lifted toward the front of the frame 100. As noted above, the wing panels 108 and 110 are foldably coupled to each of the central panel 102 and the end panel 104 via fold lines. The fold lines enable a user to manually rotate the wing panels 108 and 110 with respect to the central panel 102 and the end panel 104 to bring the wing panels 108 and 110 into the orientation shown in FIGS. 2A and 2D. In the depicted embodiment, the wing panels 108 and 110 are oriented so that the tabs 112 and 114 are pointed upward.

As can be seen in FIG. 2B, the removable panel 202 has been removed from the sheet assembly 200 so that the container portion 228 and the disposable portions 230 and 232 are separated from each other and from the sheet assembly 200. To remove the removable panel 202, the weakened portions between the removable panel 202 and the slot panels 206 and 206 and the weakened portions between the removable panel 202 and the side panel 226 were broken (e.g., the perforations were torn). After the disposable portions 230 and 232 are removed, they can be disposed of (e.g., recycled, repurposed, etc.). With the removable panel 202 removed, the sheet 208 spans between the slot panels 204 and 206 and the side panel 226. In this arrangement, the sheet 208 is free to move (e.g., twist, bend, stretch, etc.) between the slot panels 204 and 206 and the side panel 226. Each of the slot panels 204 and 206 is couplable to one of the wing panels 108 and 110. In the depicted embedment, each of the tabs 112 and 114 is configured to be inserted through both of the slots 214 and 216 of the slot panel 204 or through both of the slots 222 and 224 of the slot panel 206.

As can be seen in the instance shown in FIG. 2C, the sheet assembly 300 can remain in the same lay-flat configuration at the second instance. In other embodiments, the sheet assembly 300 could be treated in the same way as the sheet assembly 200 is treated in the second instance.

Figure 3A:
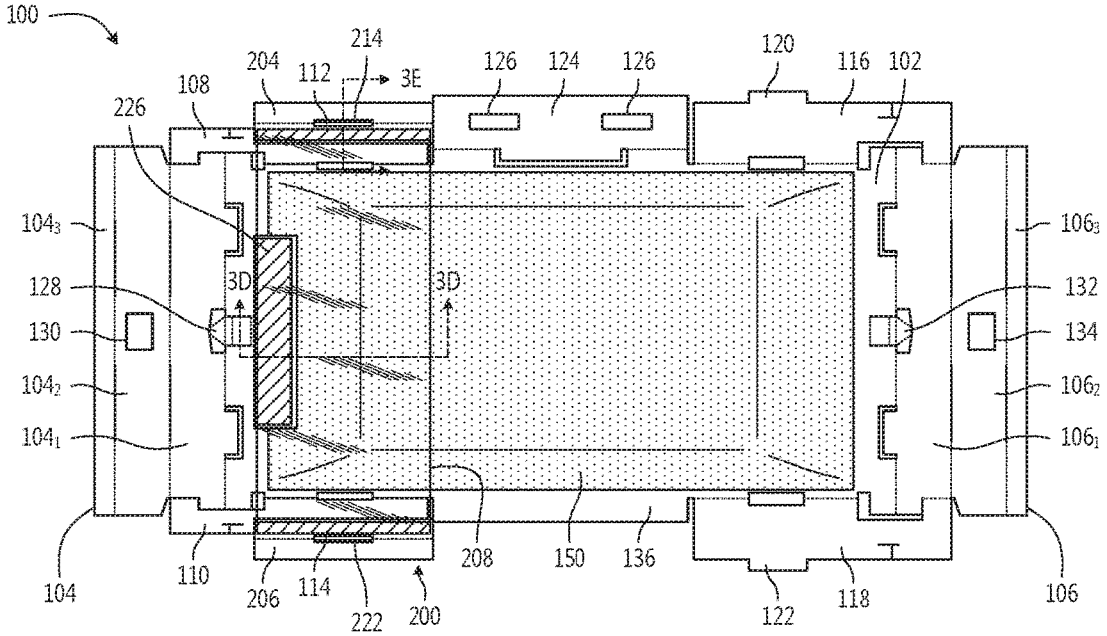
FIGS. 3A, 3B, and 3C depict a third instance of the frame and the first sheet assembly, a peripheral container formed from the container portion, and the second sheet assembly, in accordance with the embodiments disclosed herein.
Figure 3B:
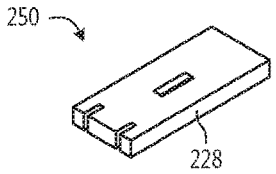
Figure 3C:
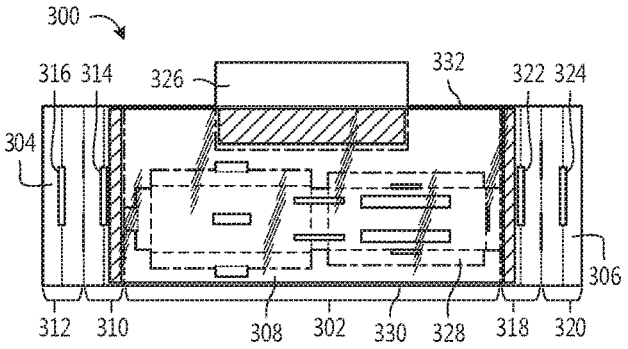
Figure 3D:
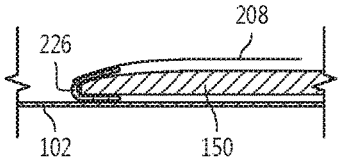
FIG. 3D depicts a cross-sectional partial view of the frame, the object, and the side panel of the first sheet assembly, in accordance with the embodiments disclosed herein.
Figure 3E:
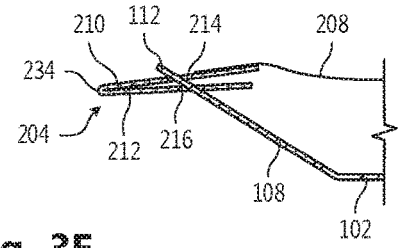
FIG. 3E depicts a cross-sectional partial view of the frame and the second sheet assembly, in accordance with the embodiments disclosed herein.

FIGS. 3A, 3B, and 3C depict a third instance of the frame 100 and the sheet assembly 200, a peripheral container 250 formed from the container portion 228, and the sheet assembly 300. FIG. 3D depicts a cross-sectional partial view of the frame 100, the object 150, and the side panel 226 of the sheet assembly 200. FIG. 3E depicts a cross-sectional partial view of the frame 100 and the sheet assembly 200.

As can be seen in FIGS. 3A and 3D, the tab 112 has been inserted through the slots 214 and 216 of the slot panel 204. Before inserting the tab 112 through the slots 214 and 216, the slot panel 204 was folded about the fold line between the first and second sections 210 and 212 to form a folded edge 234 and to place the first and second sections 210 and 212 in an overlapping orientation. In some embodiments, including the embodiment shown in FIG. 3E, the slots 214 and 216 are in an offset position because the slots 214 and 216 are located at different distances away from the folded edge 234. In this orientation, the slots 214 and 216 are not perfectly aligned with each other. In some embodiments, the distances of the slots 214 and 216 away from the folded edge 234 are selected based on an expected angle of the wing panel 108. In some embodiments, the distances of the slots 214 and 216 away from the folded edge 234 are selected based on a desired "locked" feel of the sheet assembly 200 when the wing panels 108 and 110 are rotated down toward the back of the frame 100, as discussed in greater detail below.

As can be seen in FIG. 3A, the tab 114 has been inserted through the slots 222 and 224 of the slot panel 206. Before inserting the tab 114 through the slots 222 and 224, the slot panel 206 was folded about the fold line between the first and second sections 218 and 220 to form a folded edge and to place the first and second sections 218 and 220 in an overlapping orientation. In some embodiments, the slots 222 and 224 are in an offset position because the slots 222 and 224 are located at different distances away from the folded edge. In this orientation, the slots 222 and 224 are not perfectly aligned with each other. In some embodiments, the distances of the slots 222 and 224 away from the folded edge are selected based on an expected angle of the wing panel 110. In some embodiments, the distances of the slots 222 and 224 away from the folded edge are selected based on a desired "locked" feel of the sheet assembly 200 when the wing panels 108 and 110 are rotated down toward the back of the frame 100, as discussed in greater detail below.

As shown in FIG. 3B, the container portion 228 removed from the sheet assembly 200 can be formed into a peripheral container 250, such as a box. In some embodiments, such as the embodiment shown in FIG. 2B, the container portion 228 may include slots, tabs, fold lines, weakened portion, or any other features that aid in forming the container portion 228 into the peripheral container 250. After the peripheral container 250 has been formed, it can be set aside for later use.

As can be seen in the instance shown in FIG. 3C, the sheet assembly 300 can remain in the same lay-flat configuration at the second instance. In other embodiments, the sheet assembly 300 could be treated in the same way as the sheet assembly 200 is treated in the third instance.

As shown in FIG. 3D, the side panel 226 of the sheet assembly 200 may be folded around the lateral side of the object 150. In the depicted embodiment, a portion of the side panel 226 that is not fixed to the sheet 208 is located between the central panel 102 and the object 150. The portion of the side panel 226 that is fixed to the sheet 208 is located on the other side of the object. In some embodiments, the side panel 226 may have one or more fold lines to aid in the folding of the side panel 226 around the lateral side of the object 150.

Figure 4A:
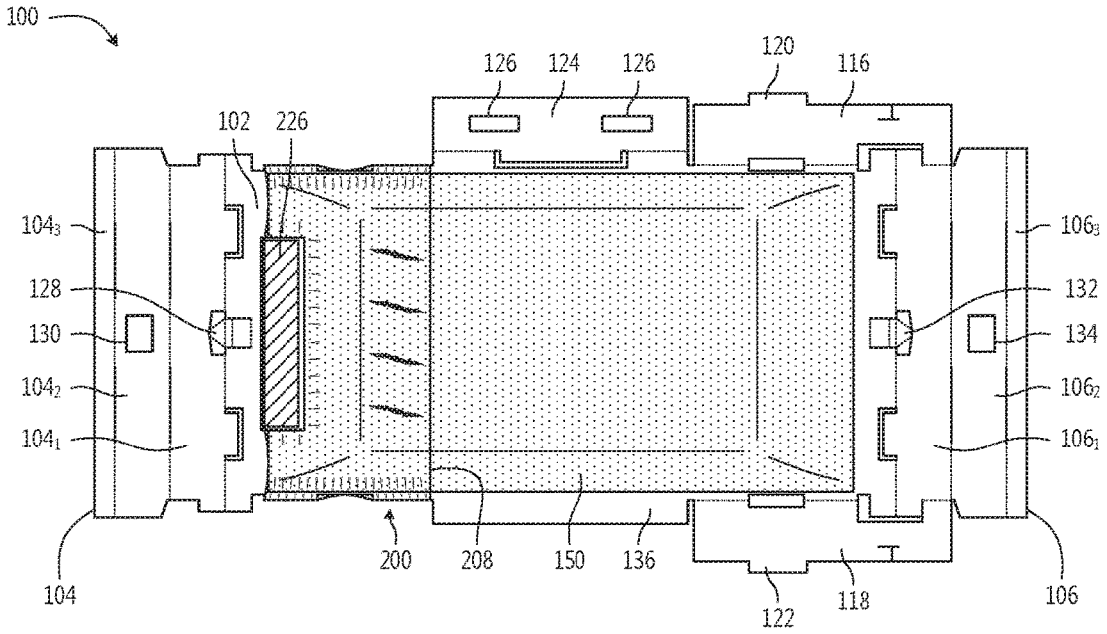
FIGS. 4A and 4B depict a fourth instance of the frame and the first and second sheet assemblies, in accordance with the embodiments disclosed herein.
Figure 4B:
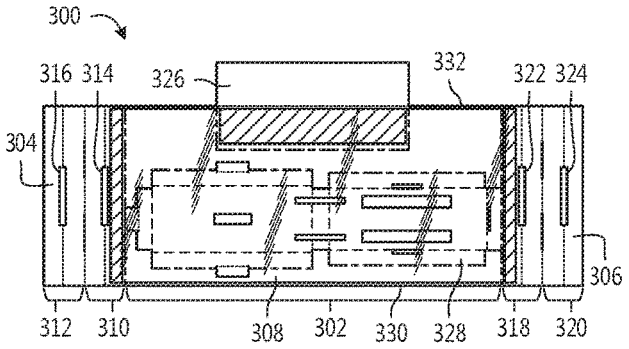

FIGS. 4A and 4B depict a fourth instance of the frame 100 and the sheet assemblies 200 and 300. From the third instance shown in FIG. 3A, each of the wing panels 108 and 110 can be rotated away from the front of the frame 100. The wing panels 108 and 110 can continue to be rotated until the wing panels 108 and 110 are rotated down to the back of the frame 100, as shown in the fourth instance depicted in FIG. 4A. In the fourth instance, a portion of each of the wing panels 108 and 110 is located behind a portion of the central panel 102 and a portion of the end panel 104.

This rotation of the wing panels 108 and 110 to the orientation shown in FIG. 4A moves the slot panels 204 and 206 so that the sheet 208 is pulled tightly over the side of the object 150. The sheet 208 retains the side of the object 150 against the central panel 102 of the frame 100. The sheet 208 also retains the side panel 226 along the lateral side of the object 150 such that the side panel 226 resists movement of the object 150 to the left in the depiction shown in FIG. 4A. In some embodiments, when the wing panels 108 and 110 are in the orientation shown in FIG. 4A, the tension on the sheet 208 toggles (or "locks") the wing panels 108 and 110 into place with the sheet 208 tightly over the side of the object 150 and the side of the object 150 retained against the central panel 102 of the frame 100.

As can be seen in the instance shown in FIG. 4B, the sheet assembly 300 can remain in the same lay-flat configuration at the second instance. In other embodiments, the sheet assembly 300 could be treated in the same way as the sheet assembly 200 is treated in the fourth instance.

Figure 5A:
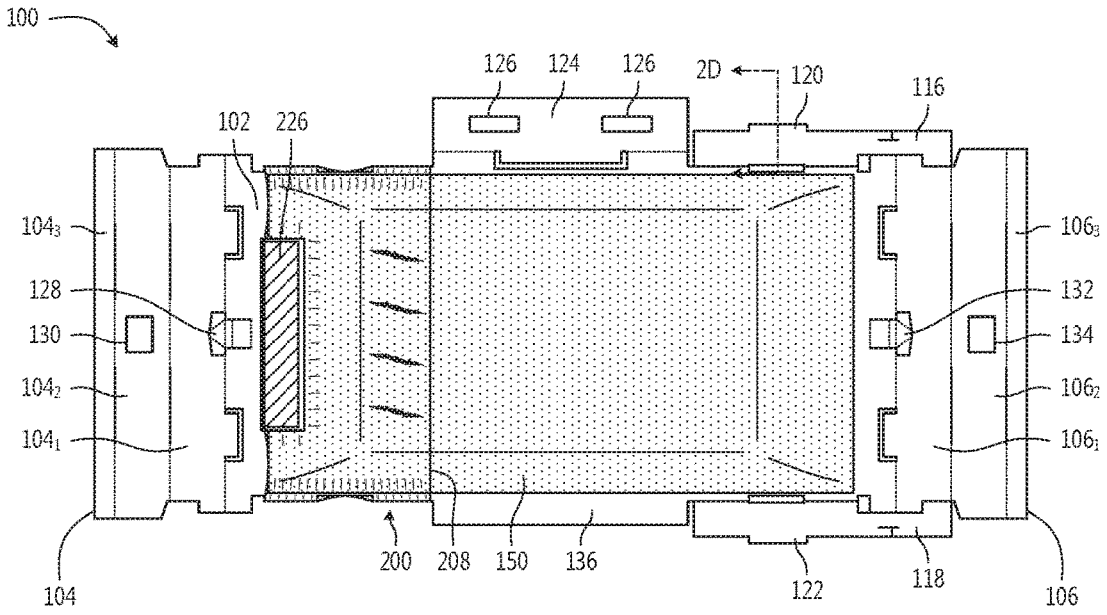
FIGS. 5A and 5B depict a fifth instance of the frame, the first sheet assembly, and the second sheet assembly, in accordance with the embodiments disclosed herein.
Figure 5C:
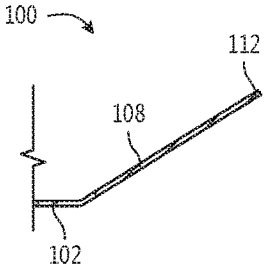
FIG. 5C depict a cross-sectional partial view of the frame shown in FIGS. 5A and 5B with the wing panel having been lifted toward the front of the frame.
Figure 5B:
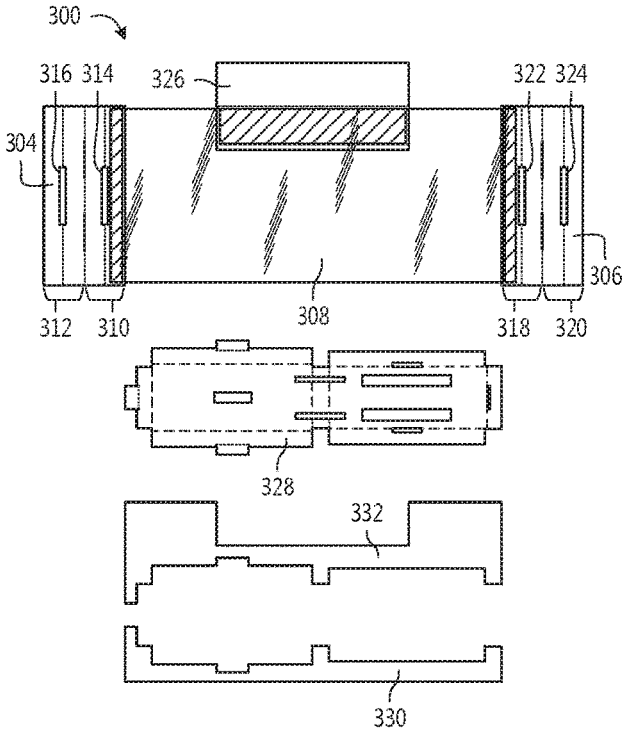

FIGS. 5A and 5B depict a fifth instance of the frame 100, the sheet assembly 200, and the sheet assembly 300. FIG. 5C depicts a cross-sectional partial view of the frame 100. As can be seen in FIGS. 5A and 5C, the wing panel 116 has been lifted toward the front of the frame 100. The wing panel 118 has similarly been lifted toward the front of the frame 100. As noted above, the wing panels 116 and 118 are foldably coupled to each of the central panel 102 and the end panel 104 via fold lines. The fold lines enable a user to manually rotate the wing panels 116 and 118 with respect to the central panel 102 and the end panel 104 to bring the wing panels 116 and 118 into the orientation shown in FIGS. 5A and 5C. In the depicted embodiment, the wing panels 116 and 118 are oriented so that the tabs 120 and 122 are pointed upward.

As can be seen in FIG. 5B, the removable panel 302 has been removed from the sheet assembly 300 so that the container portion 328 and the disposable portions 330 and 332 are separated from each other and from the sheet assembly 300. To remove the removable panel 302, the weakened portions between the removable panel 302 and the slot panels 304 and 306 and the weakened portions between the removable panel 302 and the side panel 326 were broken (e.g., the perforations were torn). After the disposable portions 330 and 332 are removed, they can be disposed of (e.g., recycled, repurposed, etc.). With the removable panel 302 removed, the sheet 308 spans between the slot panels 304 and 306 and the side panel 326. In this arrangement, the sheet 308 is free to move (e.g., twist, bend, stretch, etc.) between the slot panels 304 and 306 and the side panel 326. Each of the slot panels 304 and 306 is couplable to one of the wing panels 108 and 110. In the depicted embedment, each of the tabs 120 and 122 is configured to be inserted through both of the slots 314 and 316 of the slot panel 304 or through both of the slots 322 and 324 of the slot panel 306.

Figure 6A:
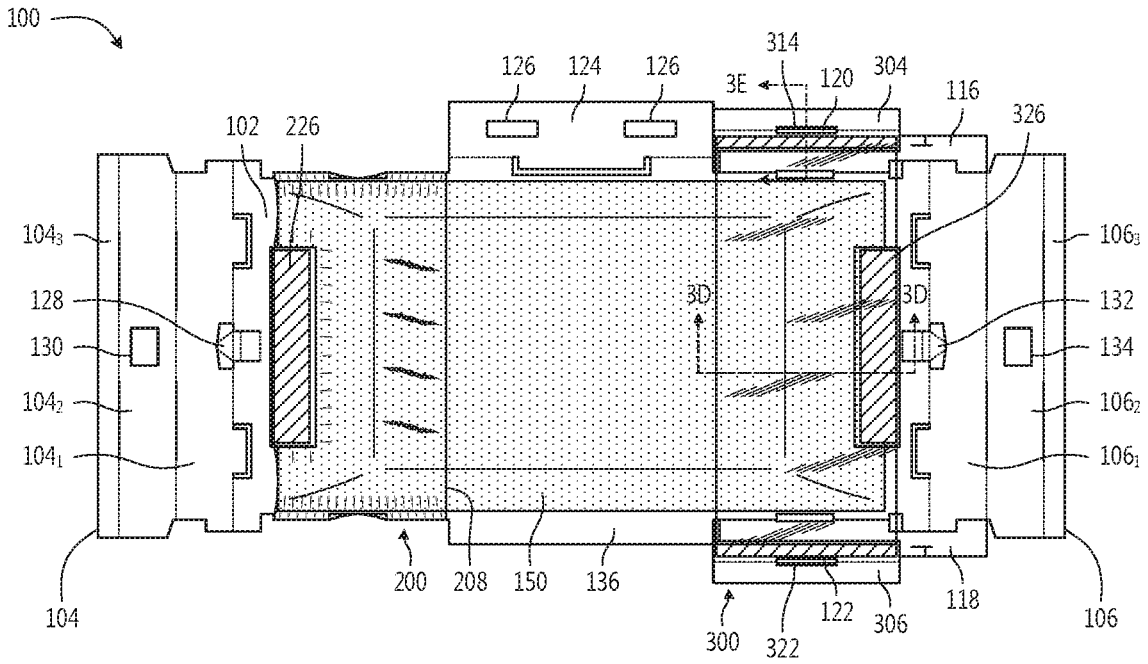
FIGS. 6A and 6B depict a sixth instance of the frame, the first and second sheet assemblies, and a peripheral container formed from the container portion, in accordance with the embodiments disclosed herein.
Figure 6B:
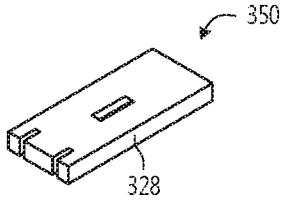
Figure 6C:
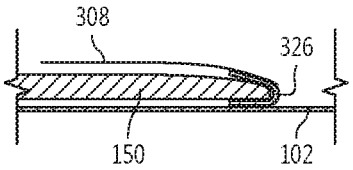
FIG. 6C depicts a cross-sectional partial view of the frame, the object, and the side panel of the second sheet assembly, in accordance with the embodiments disclosed herein.
Figure 6D:
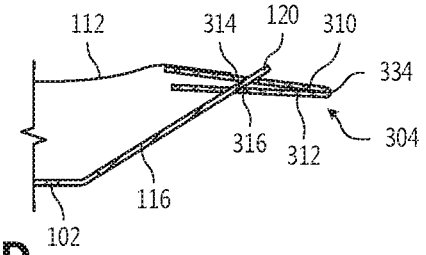
FIG. 6D depicts a cross-sectional partial view of the frame and the sheet assembly, in accordance with the embodiments disclosed herein.

FIGS. 6A and 6B depict a sixth instance of the frame 100, the sheet assemblies 200 and 300, and a peripheral container 350 formed from the container portion 328. FIG. 6C depicts a cross-sectional partial view of the frame 100, the object 150, and the side panel 326 of the sheet assembly 300. FIG. 6D depicts a cross-sectional partial view of the frame 100 and the sheet assembly 300.

As can be seen in FIGS. 6A and 6D, the tab 120 has been inserted through the slots 314 and 316 of the slot panel 304. Before inserting the tab 112 through the slots 314 and 316, the slot panel 304 was folded about the fold line between the first and second sections 310 and 312 to form a folded edge 334 and to place the first and second sections 310 and 312 in an overlapping orientation. In some embodiments, including the embodiment shown in FIG. 6D, the slots 314 and 316 are in an offset position because the slots 314 and 316 are located at different distances away from the folded edge 334. In this orientation, the slots 314 and 316 are not perfectly aligned with each other. In some embodiments, the distances of the slots 314 and 316 away from the folded edge 334 are selected based on an expected angle of the wing panel 110. In some embodiments, the distances of the slots 314 and 316 away from the folded edge 334 are selected based on a desired "locked" feel of the sheet assembly 300 when the wing panels 116 and 118 are rotated down toward the back of the frame 100, as discussed in greater detail below.

As can be seen in FIG. 6A, the tab 122 has been inserted through the slots 322 and 324 of the slot panel 306. Before inserting the tab 122 through the slots 322 and 324, the slot panel 306 was folded about the fold line between the first and second sections 318 and 320 to form a folded edge and to place the first and second sections 318 and 320 in an overlapping orientation. In some embodiments, the slots 322 and 324 are in an offset position because the slots 322 and 324 are located at different distances away from the folded edge. In this orientation, the slots 322 and 324 are not perfectly aligned with each other. In some embodiments, the distances of the slots 322 and 324 away from the folded edge are selected based on an expected angle of the wing panel 118. In some embodiments, the distances of the slots 322 and 324 away from the folded edge are selected based on a desired "locked" feel of the sheet assembly 300 when the wing panels 116 and 118 are rotated down toward the back of the frame 100, as discussed in greater detail below.

As shown in FIG. 6B, the container portion 328 removed from the sheet assembly 300 can be formed into a peripheral container 350, such as a box. In some embodiments, such as the embodiment shown in FIG. 5B, the container portion 328 may include slots, tabs, fold lines, weakened portion, or any other features that aid in forming the container portion 328 into the peripheral container 350. After the peripheral container 350 has been formed, it can be set aside for later use.

As shown in FIG. 6C, the side panel 326 of the sheet assembly 300 may be folded around the lateral side of the object 150. In the depicted embodiment, a portion of the side panel 326 that is not fixed to the sheet 308 is located between the central panel 102 and the object 150. The portion of the side panel 326 that is fixed to the sheet 308 is located on the other side of the object. In some embodiments, the side panel 326 may have one or more fold lines to aid in the folding of the side panel 326 around the lateral side of the object 150.

Figure 7A:
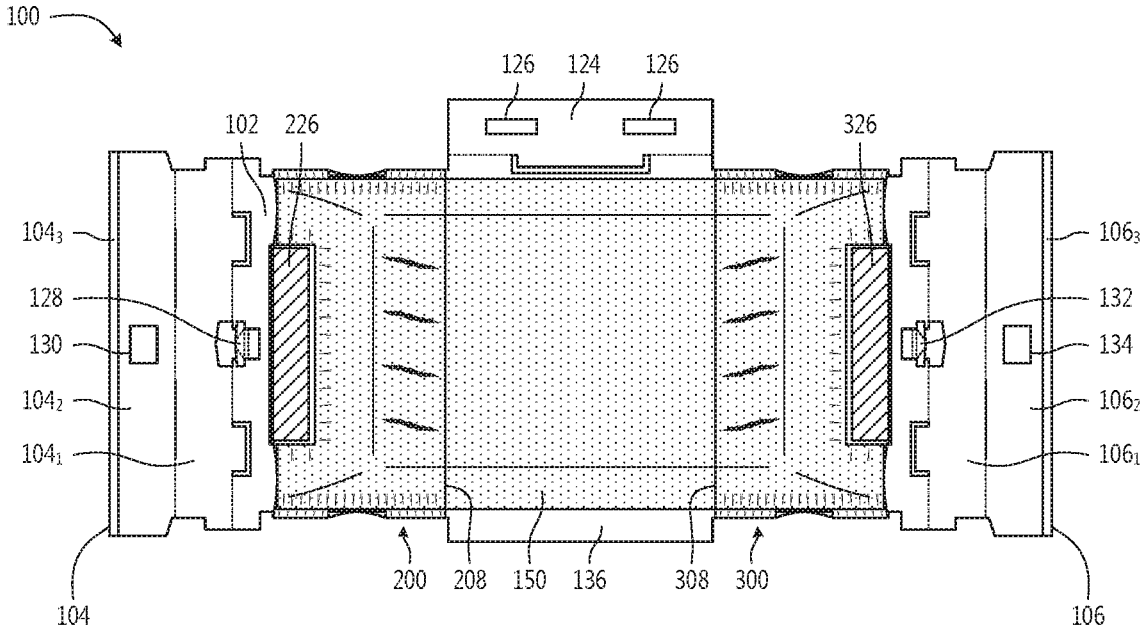
FIGS. 7A and 7B depict front and top views, respectively, of a seventh instance of the frame and the first and second sheet assemblies, in accordance with the embodiments disclosed herein.
Figure 7B:
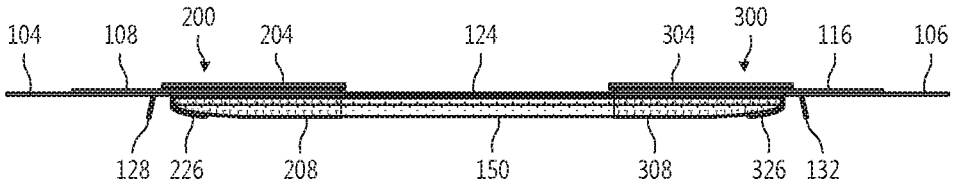

FIGS. 7A and 7B depict front and top views, respectively, of a seventh instance of the frame 100 and the sheet assemblies 200 and 300. From the third instance shown in FIG. 6A, each of the wing panels 116 and 118 can be rotated away from the front of the frame 100. The wing panels 116 and 118 can continue to be rotated until the wing panels 116 and 118 are rotated down to the back of the frame 100, as shown in the seventh instance depicted in FIGS. 7A and 7B. In the seventh instance, a portion of each of the wing panels 116 and 118 is located behind a portion of the central panel 102 and a portion of the end panel 106.

This rotation of the wing panels 116 and 118 to the orientation shown in FIGS. 7A and 7B moves the slot panels 304 and 306 so that the sheet 308 is pulled tightly over the side of the object 150. The sheet 308 retains the side of the object 150 against the central panel 102 of the frame 100. The sheet 308 also retains the side panel 326 along the lateral side of the object 150 such that the side panel 326 resists movement of the object 150 to the right in the depiction shown in FIG. 7A. In some embodiments, when the wing panels 116 and 118 are in the orientation shown in FIGS. 7A and 7B, the tension on the sheet 308 toggles (or "locks") the wing panels 116 and 118 into place with the sheet 308 tightly over the side of the object 150 and the side of the object 150 retained against the central panel 102 of the frame 100.

In the embodiment depicted in FIGS. 7A and 7B, each of the handle panel 124 and the bottom panel 136 is substantially centered between the end panels 104 and 106. In addition, each of the handle panel 124 and the bottom panel 136 extends from the central panel 102 at a location that is between the sheets 208 and 308. As is also depicted in FIGS. 7A and 7B, the dovetail tabs 128 and 132 have been lifted toward the front of the frame 100. As noted above, the dovetail tabs 128 and 132 are foldably coupled to the central panel 102 via fold lines. The fold lines enable a user to manually rotate the dovetail tabs 128 and 132 with respect to the central panel 102 to bring the dovetail tabs 128 and 132 into the orientation shown in FIGS. 7A and 7B.

Figure 8A:
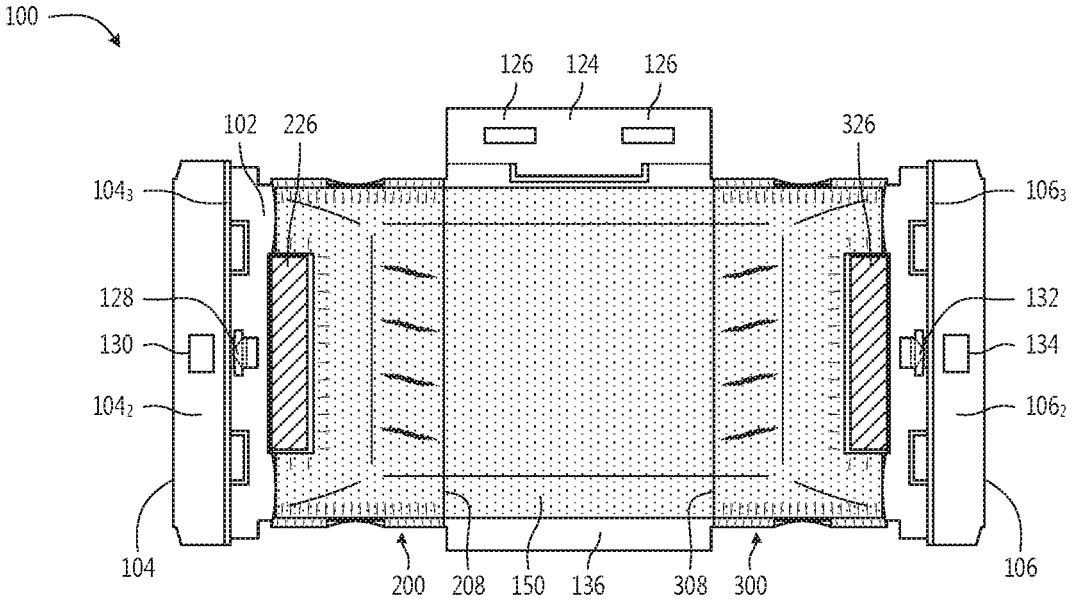
FIGS. 8A and 8B depict front and top views, respectively, of an eighth instance of the frame and the first and second sheet assemblies, in accordance with the embodiments disclosed herein.
Figure 8B:
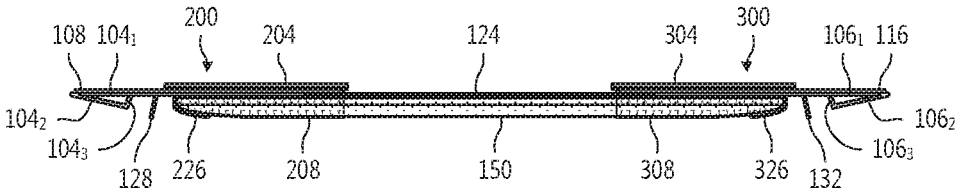

FIGS. 8A and 8B depict front and top views, respectively, of an eighth instance of the frame 100 and the sheet assemblies 200 and 300. From the orientation shown in FIGS. 7A and 7B, the end panels 104 and 106 have been folded toward the front of the central panel 102. In the depicted embodiment, the end of the third section $\mathbf{104}_3$ of the end panel 104 has been brought to the fold lines between the central panel 102 and the end panel 104 and the end of the third section $\mathbf{106}_3$ of the end panel 106 has been brought to the fold lines between the central panel 102 and the end panel 106. The fold lines between the first and second sections $\mathbf{104}_1$ and $\mathbf{104}_2$, the fold lines between the second and third sections $\mathbf{104}_2$ and $\mathbf{104}_3$, the fold lines between the first and second sections $\mathbf{106}_1$ and $\mathbf{106}_2$, and the fold lines between the second and third sections $\mathbf{106}_2$ and $\mathbf{106}_3$ aid in the folding of the end panels 104 and 106 into the configuration shown in FIGS. 8A and 8B.

Figure 9A:
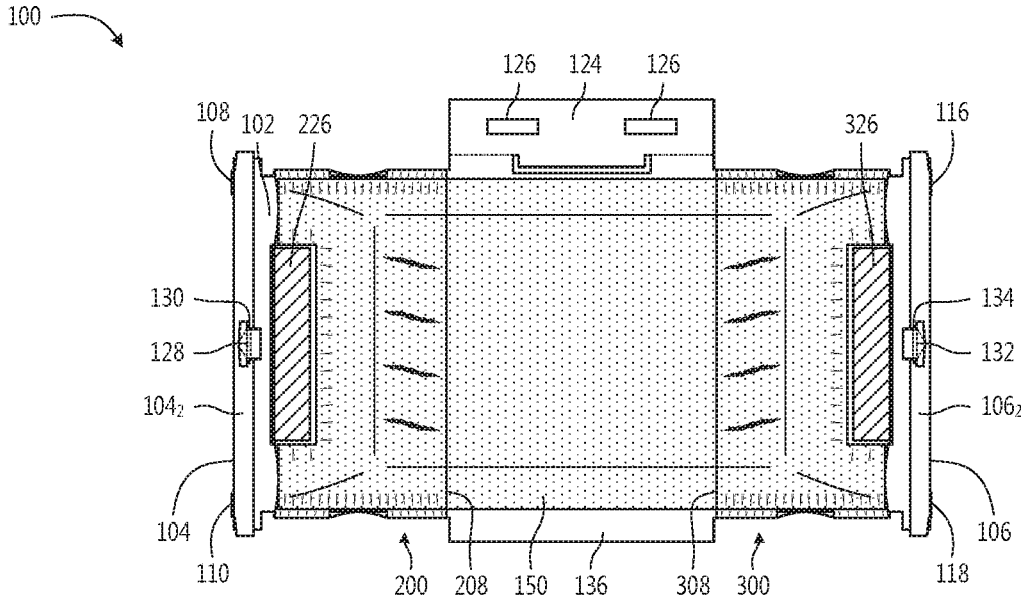
FIGS. 9A and 9B depict front and top views, respectively, of a ninth instance of the frame and the first and second sheet assemblies, in accordance with the embodiments disclosed herein.
Figure 9B:
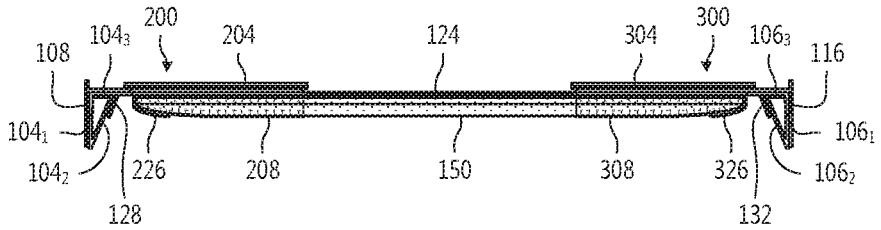

FIGS. 9A and 9B depict front and top views, respectively, of a ninth instance of the frame 100 and the sheet assemblies 200 and 300. From the orientation shown in FIGS. 8A and 8B, the end panel 104 has been rotated about the fold line between the central panel 102 and the end panel 104 until the third section $\mathbf{104}_3$ is substantially parallel with the central panel 102 and the first and second sections $\mathbf{104}_1$ and $\mathbf{104}_2$ extend away from the central panel 102. Similarly, the end panel 106 has been rotated about the fold line between the central panel 102 and the end panel 104 until the third section $\mathbf{106}_3$ is substantially parallel with the central panel 102 and the first and second sections $\mathbf{106}_1$ and $\mathbf{106}_2$ extend away from the central panel 102. In some embodiments, when the end panels 104 and 106 are in the configuration shown in FIGS. 9A and 9B, the end panels 104 and 106 extend further away from the central panel than the object 150. As is also shown in the depicted embodiment, the dovetail tabs 128 and 132 have been lifted so that the dovetail tabs 128 and 132 are in contact with the second section $\mathbf{104}_2$ and the second section $\mathbf{106}_2$, respectively.

Figure 10A:
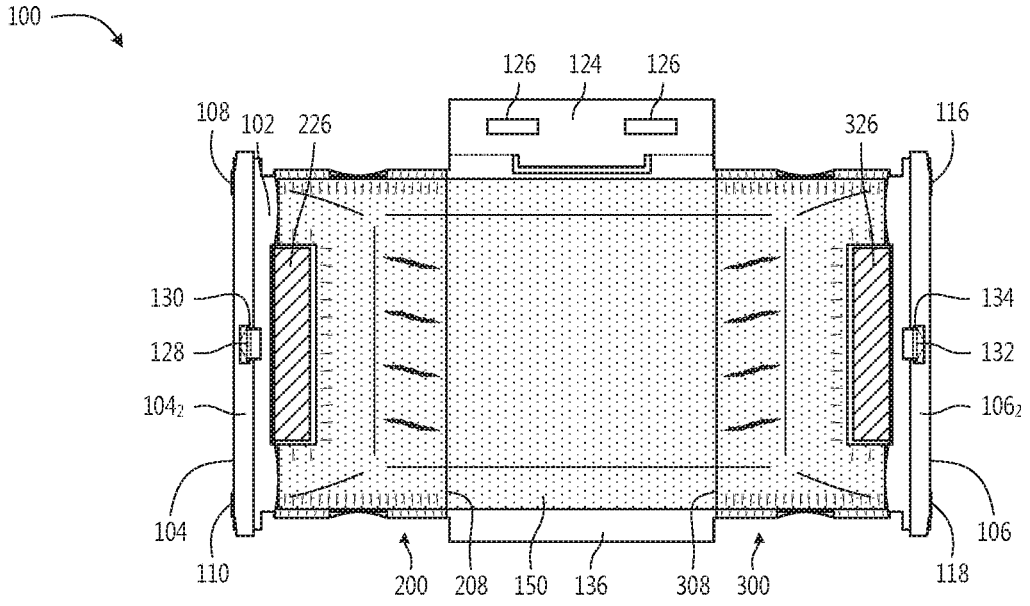
FIGS. 10A and 10B depict front and top views, respectively, of a tenth instance of the frame and the first and second sheet assemblies, in accordance with the embodiments disclosed herein.
Figure 10B:
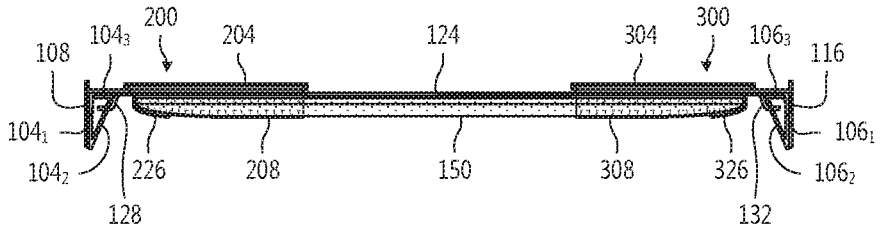

FIGS. 10A and 10B depict front and top views, respectively, of a tenth instance of the frame 100 and the sheet assemblies 200 and 300. From the instance shown in FIGS. 9A and 9B, the dovetail tabs 128 and 132 have been folded into the slots 130 and 134, respectively. The dovetail tab 128 serves to secure the central panel 102 to the second section $\mathbf{104}_2$ to hold the end panel 104 in a folded configuration with respect to the central panel 102. For example, the dovetail tab 128 deters the end panel 104 from unfolding (or "unrolling") from the folded configuration shown in FIGS. 10A and 10B. Similarly, the dovetail tab 132 serves to secure the central panel 102 to the second section $\mathbf{106}_2$ to hold the end panel 106 in a folded configuration with respect to the central panel 102. For example, the dovetail tab 132 deters the end panel 106 from unfolding or unrolling from the folded configuration shown in FIGS. 10A and 10B. While the depicted embodiment includes dovetail tabs 128 and 132 and slots 130 and 134 to secure the central panel 102 to the ends panels 104 and 106, it will be noted that any other type of securing mechanism could be used, such as hook-and-loop fasteners, tape, adhesives (e.g., glue), and the like. With the frame 100 and the sheet assemblies 200 and 300 in the orientation shown in FIGS. 10A and 10B, the frame 100 and the sheet assemblies 200 and 300 form a retention packaging assembly (or "retention packaging") with the object 150 inside.

With the sheets 208 and 308 locked into place and the end panels 104 and 106 secured in the folded configuration, as shown in FIGS. 10A and 10B, the retention packaging assembly is capable of retaining the object 150 to the central panel 102 even when the object 150 is not merely resting on the front of central panel of the retention packaging assembly. In particular, the retention packaging assembly can be oriented vertically while still retaining the object 150 to the central panel 102 of the frame 100. In some embodiments, such as when the handle panel 124 in centered laterally on the frame 100, a user may be able to grasp the handle panel 124 using one or both of the slots 126 and lift the retention packaging assembly with the object 150 inside. In those embodiments, the laterally-central location of the handle panel 124 on the retention packaging assembly results in a somewhat-balanced lateral weight of the object 150 when the user lifts the retention packaging assembly and the object 150. In some embodiments, when the retention packaging assembly is vertical, a user may grasp one or both of the end panels 104 and 106 in the folded configuration.

Figure 11:
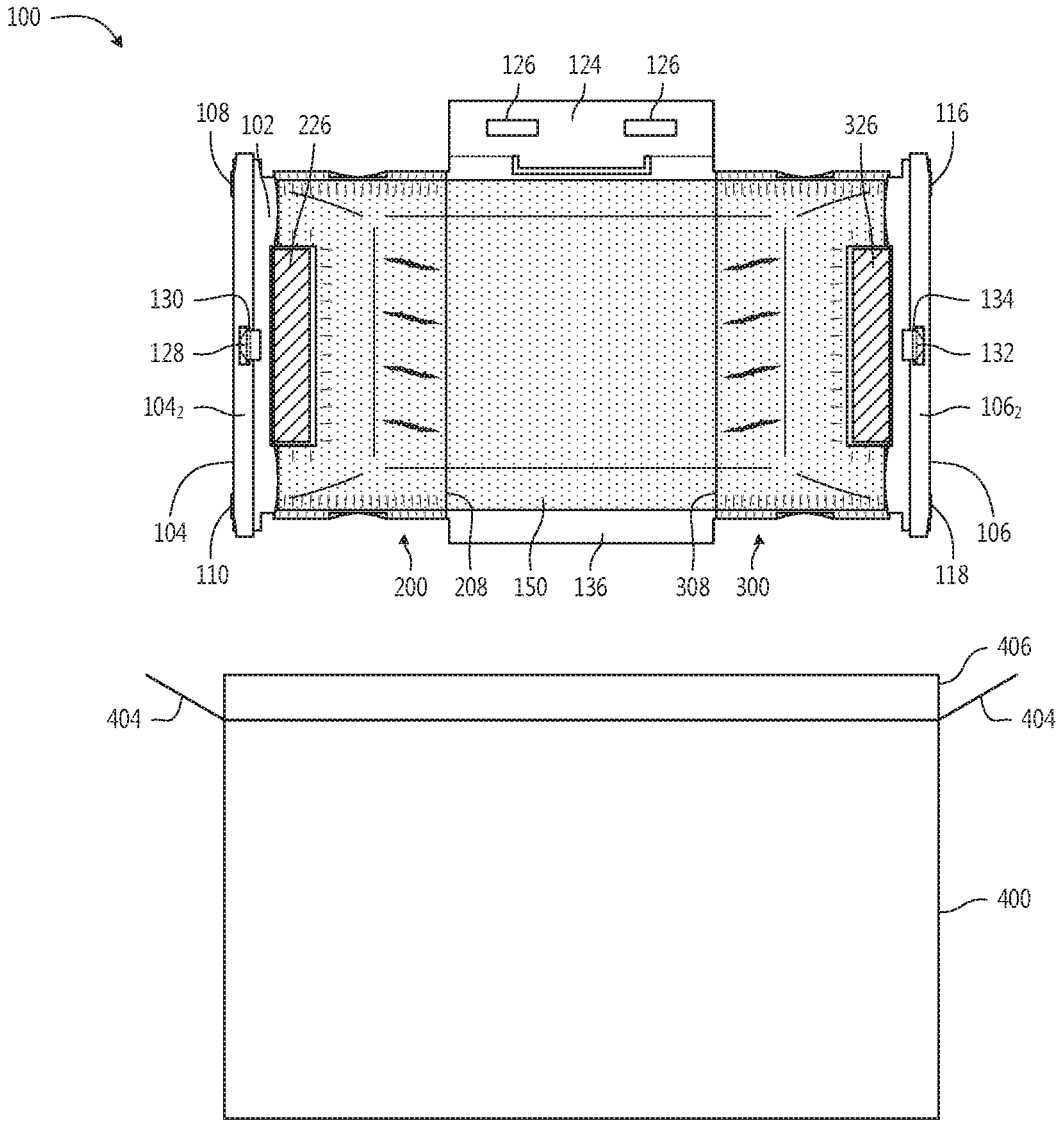
FIG. 11 depicts an eleventh instance of the retention packaging assembly of the frame and the first and second sheet assemblies with the object held above an opening of a container, in accordance with the embodiments disclosed herein.

FIG. 11 depicts an eleventh instance of the retention packaging assembly of the frame 100 and the sheet assemblies 200 and 300 with the object 150 held above an opening of a container 400. In the depicted embodiment, the container 400 is a box (e.g., a cardboard box) that has lateral flaps 404 and longitudinal flaps 406. In FIG. 11, the lateral and longitudinal flaps 404 and 406 are open so that the container 400 is open. In other instances, the lateral and longitudinal flaps 404 and 406 may be closed to close the opening of the container 400. In the particular instance in FIG. 11, a user may align the retention packaging assembly and the object 150 with the opening of the container 400.

Figure 12A:
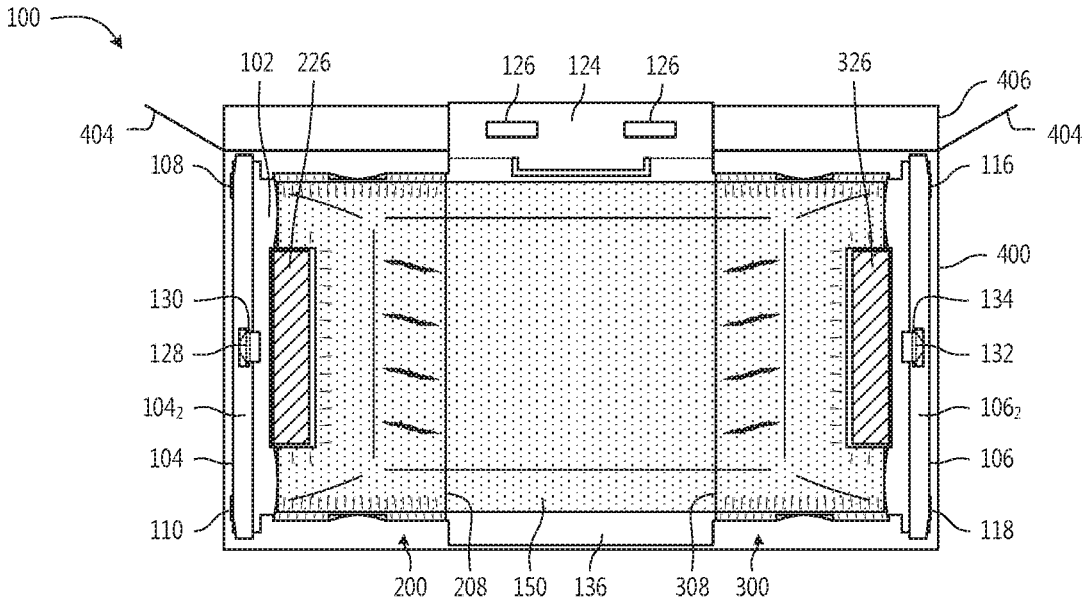
FIGS. 12A and 12B depict front and top views, respectively, of a twelfth instance of the frame, the first and second sheet assemblies, and the container, in accordance with the embodiments disclosed herein.
Figure 12B:
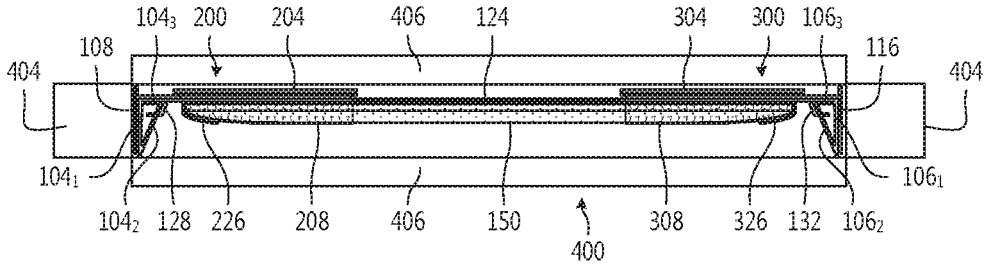

FIGS. 12A and 12B depict front and top views, respectively, of a twelfth instance of the frame 100, the sheet assemblies 200 and 300, and the container 400. At the instance shown in FIGS. 12A and 12B, the retention packaging assembly (e.g., the frame 100 and the sheet assemblies 200 and 300) and the object 150 have been slid into the container 400. In FIG. 12B, the front of the container 400 is transparent for convenience in viewing the retention packaging assembly and the object 150 inside of the container 400; however, in most practical solutions, the container 400 will be made from a material (e.g., cardboard) that is not transparent.

In some embodiments, including the embodiment shown in FIGS. 12A and 12B, the distance between the lateral sides (i.e., the left and right sides in FIGS. 12A and 12B) of the end panels 104 and 106 in the folded configuration is less than the longitudinal length of the container 400 (i.e., the left-to-right length of the container 400 in FIGS. 12A and 12B). In some embodiments, including the embodiment shown in FIGS. 12A and 12B, the distance from the slot panels 204, 206, 304, and 306 behind the central panel 102 to the ends of the end panels 104 and 106 that are furthest away from the central panel 102 in the folded configuration is less than the depth of the container 400 (i.e., the top-to-bottom length of the container 400 in FIG. 12B).

Figure 13A:
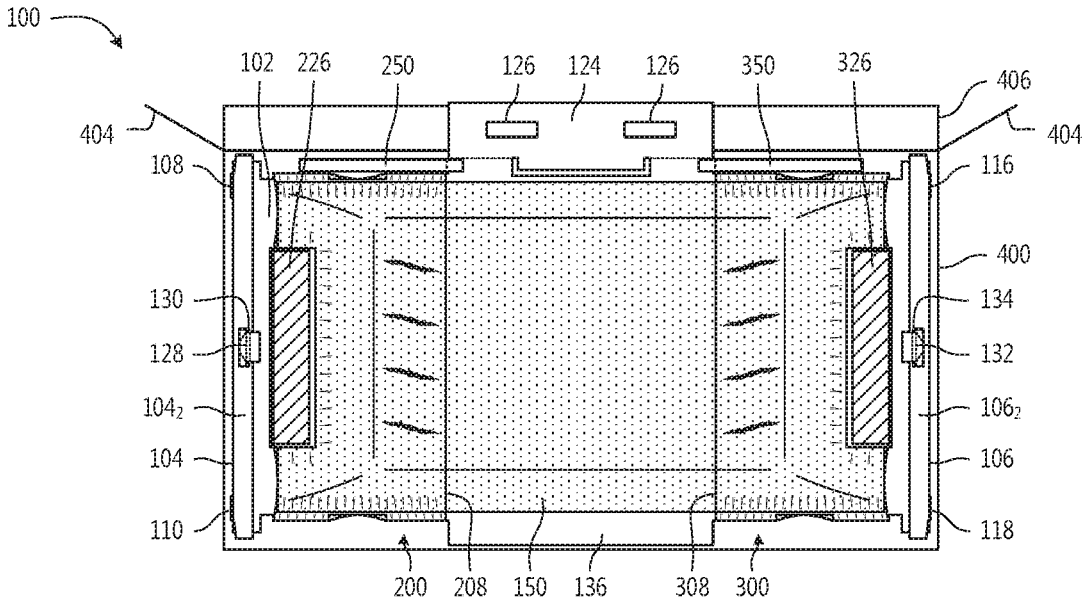
FIGS. 13A and 13B depict front and top views, respectively, of a thirteenth instance of the frame, the first and second sheet assemblies, in accordance with the embodiments disclosed herein.
Figure 13B:
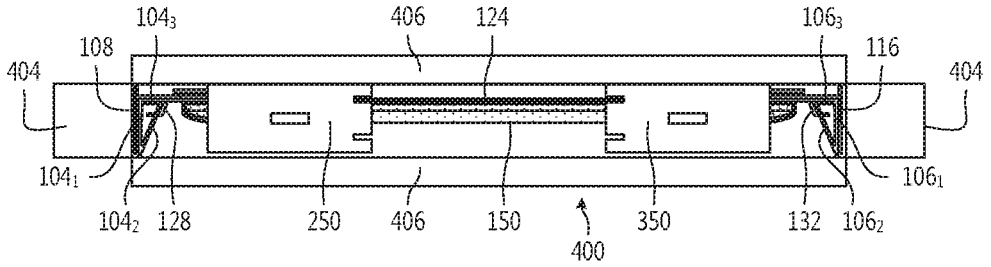

FIGS. 13A and 13B depict front and top views, respectively, of a thirteenth instance of the frame 100, the sheet assemblies 200 and 300, and the container 400. The peripheral containers 250 and 350, which were formed from the container portions 228 and 328, respectively, have been inserted into the container 400. In some embodiments, the peripheral containers 250 and 350 have been filled with one or more peripheral items before being placed in the container 400. Examples of peripheral items in the peripheral containers 250 and 350 include one or more of a remote control, a cord, a battery, a user manual, other documentation, or any other peripheral items. In the depicted embodiment, each of the peripheral containers 250 and 350 includes a slot through which the handle panel 124 and/or the central panel 102 can be slid. As can be seen in FIGS. 13A and 13B, a portion of the central panel 102 is located between slots in the peripheral containers 250 and 350 such that the peripheral containers 250 and 350 are arranged below the fold lines between the central panel 102 and the handle panel 124.

In some embodiments, including the embodiment shown in FIGS. 13A and 13B, the width of the peripheral containers 250 and 350 is less than the depth of the container 400 (i.e., the top-to-bottom length of the container 400 in FIG. 13B). In this way, the peripheral containers 250 and 350 fit inside the container 400. In some embodiments, the width of the peripheral containers 250 and 350 is selected to improve structural stability to the container 400 and resist deformation of the container due to forces across the depth of the container 400.

Figure 14A:
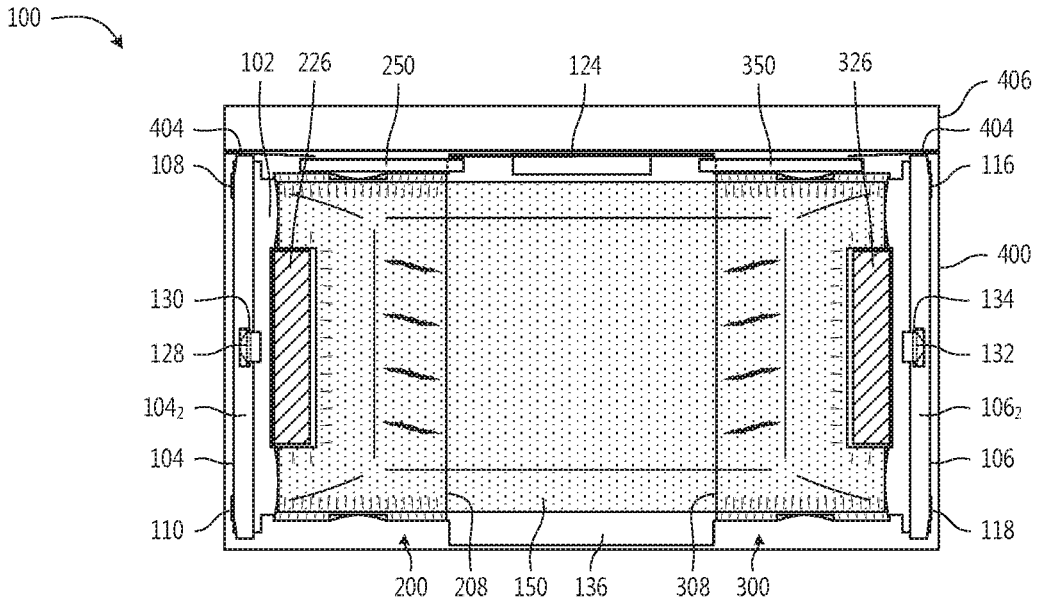
FIGS. 14A and 14B depict front and top views, respectively, of a fourteenth instance of the frame, the first and second sheet assemblies, in accordance with the embodiments disclosed herein.
Figure 14B:
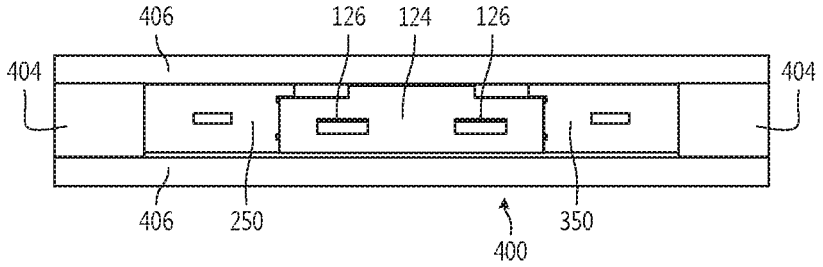

FIGS. 14A and 14B depict front and top views, respectively, of a fourteenth instance of the frame 100, the sheet assemblies 200 and 300, and the container 400. In FIGS. 14A and 14B, the handle panel 124 has been folded down from a substantially vertical position shown in FIGS. 13A and 13B to a substantially horizontal position shown in FIGS. 14A and 14B. In this position, the lateral ends of the handle panel 124 cover a lateral end of each of the peripheral containers 250 and 350. In addition, in the depicted embodiment, handle panel 124 substantially spans the opening of the container 400. In some embodiments, the dimensions of the handle panel 124 are selected to improve structural stability to the container 400 and resist deformation of the container due to forces across the depth of the container 400. The lateral flaps 404 of the container 400 have also been folded down to cover a portion of the opening of the container 400. In the depicted embodiment, portions of the lateral flaps 404 cover a lateral end of each of the peripheral containers 250 and 350 that is opposite from the lateral end that is covered by the handle panel 124.

Figure 15A:
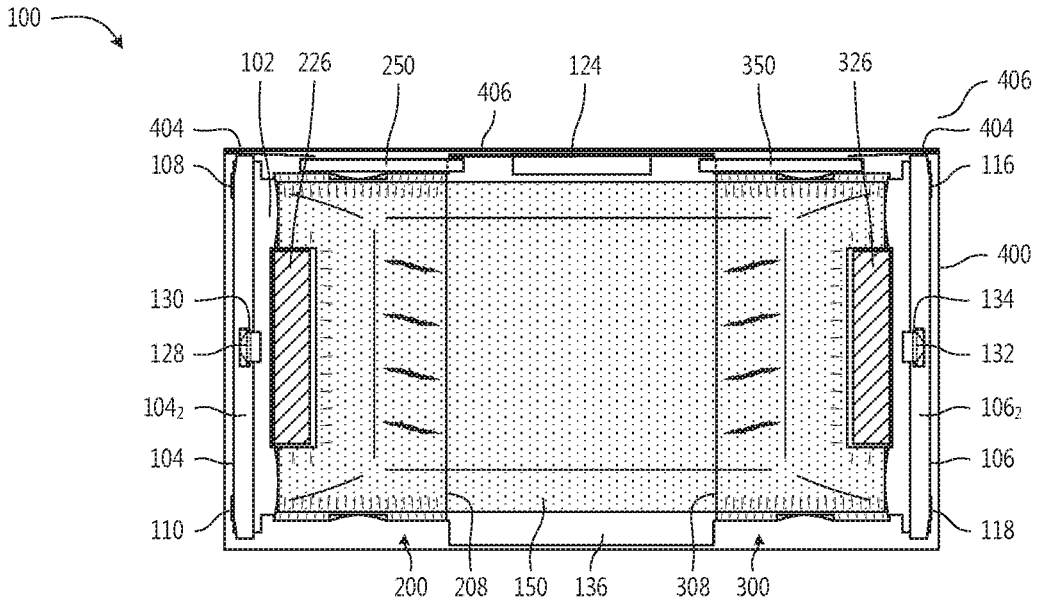
FIGS. 15A and 15B depict front and top views, respectively, of a fifteenth instance of the frame, the first and second sheet assemblies, in accordance with the embodiments disclosed herein.
Figure 15B:
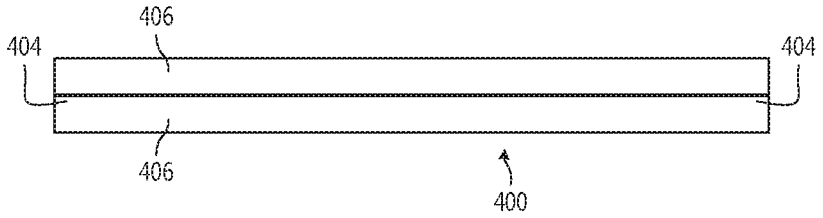

FIGS. 15A and 15B depict front and top views, respectively, of a fifteenth instance of the frame 100, the sheet assemblies 200 and 300, and the container 400. In FIGS. 15A and 15B, the longitudinal flaps 406 of the container 400 have been closed to cover the opening of the container 400. The lateral flaps 406 cover the handle panel 124, the peripheral containers 250 and 350, and the lateral flaps 404. In this configuration, the container 400 with the retention packaging assembly and the object 150 inside can be shipped or otherwise transported (e.g., shipped directly to a customer, shipped to a retail store, transported from a retail store to a home by a consumer, etc.).

With the container 400 closed, as shown in FIGS. 15A and 15B, the object 150 is fully held in place within the container 400. The retention packaging, including the frame 100 and the sheet assemblies 200 and 300, is capable of preventing the object 150 from moving to the sides of the container 400. In particular, the sheets 208 and 308 hold the object 150 from moving vertically toward the top and the bottom sides of the container 400. The side panels 226 and 326 hold the object from moving laterally (right or left in the depiction in FIGS. 15A and 15B) toward the left or right sides of the container 400. In addition, retention packaging assembly uses fewer packaging materials that other solutions, such as closed-cell polystyrene foam (e.g., Styrofoam) blocks, secondary containers, cushioning material between the depicted container and a secondary container, and the like. Also, the packaging materials included in the retention packaging assembly may be easily recyclable, such as in a curb-side recycling can at an end consumer's house. Moreover, the simplicity of the design of the retention packaging assembly also allows for relatively easy integration into a manufacturing process, resulting in savings of inventory storage space, labor, handling, and the like.

Returning to the entire process shown in FIGS. 15 to 18, the depicted retention packaging assembly is capable of protecting the television in all dimensions while improving the experience of the customer when unpacking the outer container. In addition, retention packaging assembly uses fewer packaging materials that other solutions, such as closed-cell polystyrene foam (e.g., Styrofoam) blocks, secondary containers, cushioning material between the depicted container and a secondary container, and the like. In addition, the packaging materials included in the retention packaging assembly may be easily recyclable, such as in a curb-side recycling can at a consumer's house. Moreover, the simplicity of the design of the retention packaging assembly also allows for relatively easy integration into a manufacturing process, resulting in savings of inventory storage space, labor, handling, and the like.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A retention packaging assembly, comprising:

a frame comprising:

a central panel, a first end panel foldably coupled to the central panel, a second end panel foldably coupled to the central panel, a first set of wing panels, wherein each of the first set of wing panels is foldably coupled to the central panel and to the first end panel, and a second set of wing panels, wherein each of the second set of wing panels is foldably coupled to the central panel and to the second end panel;

a first sheet assembly comprising first slot panels and a first sheet, wherein ends of the first sheet are attached to the first slot panels, wherein the first sheet spans between the first slot panels, and wherein each of the first slot panels is selectively couplable to one of the first set of wing panels; and a second sheet assembly comprising second slot panels and a second sheet, wherein ends of the second sheet are attached to the second slot panels, wherein the second sheet spans between the second slot panels, and wherein each of the second slot panels is selectively couplable to one of the second set of wing panels;

wherein, after the first slot panels are coupled to the first set of wing panels, the second slot panels are coupled to the second set of wing panels, and an object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel;

wherein the first and second end panels are configured to be folded into a folded configuration;

wherein the frame further includes a first securing mechanism configured to hold the first end panel in the folded configuration with respect to the central panel and a second securing mechanism configured to hold the second end panel in the folded configuration with respect to the central panel;

wherein the first end panel is configured to be folded into the folded configuration after the first set of wing panels are folded to the back of the frame, and wherein the second end panel is configured to be folded into the folded configuration after the second set of wing panels are folded to the back of the frame; and wherein each of the first and second end panels includes a first section and second section, wherein, when the first end panel is in the folded configuration, the first and second sections of the first end panel extend away from the front of the central panel, and wherein, when the second end panel is in the folded configuration, the first and second sections of the first end panel extend away from the front of the central panel.

2. The retention packaging assembly of claim 1, wherein each of the first set of wing panels includes a tab, wherein each of the first slot panels includes a first slot, and wherein the first slot panels are selectively couplable to the first set of wing panels by inserting the tabs of the first set of wing panels through the first slots of the first slot panels.

3. The retention packaging assembly of claim 2, wherein each of the first slot panels includes a first section that includes the first slot and a second section that includes a second slot, wherein each of the first slot panels is configured to be folded to place the first and second sections in an overlapping orientation, and wherein the each of the tabs of the first set of wing panels is configured to be inserted through both of the first and second slots of one of the first slot panels.

4. The retention packaging assembly of claim 3, wherein, when one of the first slot panels is folded with the first and second sections in the overlapping orientation, the first and second slots are in an offset position.

5. The retention packaging assembly of claim 2, wherein each of the second set of wing panels includes a tab, wherein each of the second slot panels includes a slot, and wherein the second slot panels are selectively couplable to the second set of wing panels by inserting the tabs of the second set of wing panels through the slots of the second slot panels.

6. The retention packaging assembly of claim 1, wherein, when the first end panel is in the folded configuration, the first and second sections of the first end panel extend away from the front of the central panel a distance that is further than the object extends away from the central panel, and wherein, when the second end panel is in the folded configuration, the first and second sections of the second end panel extend away from the front of the central panel a distance that is further than the object extends away from the central panel.

7. The retention packaging assembly of claim 1, wherein each of the first and second end panels further includes a third section, wherein, when the first end panel is in the folded configuration, the third section of the first end panel is substantially parallel with the central panel, and wherein, when the second end panel is in the folded configuration, the third section of the second end panel is substantially parallel with the central panel.

8. The retention packaging assembly of claim 1, wherein:

the second section of the first end panel includes a first slot and the second section of the second end panel includes a second slot, the first securing mechanism is a first dovetail tab foldably coupled to the central panel and the second securing mechanism is a second dovetail tab foldably coupled to the central panel, the first dovetail tab is configured to be secured to the first slot to hold the second section of the first end panel with respect to the central panel, and the second dovetail tab is configured to be secured to the second slot to hold the second section of the second end panel with respect to the central panel.

9. The retention packaging assembly of claim 1, wherein:

the frame further comprises a first handle panel foldably coupled to a top of the central panel, and the first handle panel includes one or more slots configured to accommodate a hand of a user to enable the user to lift the retention packaging assembly.

10. The retention packaging assembly of claim 9, wherein:

the frame further comprises a first handle panel foldably coupled to a top of the central panel, the first handle panel extends between the first and second sheets when the first and second sheets retain the first and second sides of the object to the central panel, and wherein the first handle panel is substantially centered between the first and second end panels.

11. The retention packaging assembly of claim 1, wherein the object is a flat-screen television.

12. A retention packaging assembly, comprising:

a frame comprising:

a central panel, a first end panel foldably coupled to the central panel, a second end panel foldably coupled to the central panel, a first set of wing panels, wherein each of the first set of wing panels is foldably coupled to the central panel and to the first end panel, and a second set of wing panels, wherein each of the second set of wing panels is foldably coupled to the central panel and to the second end panel;

a first sheet assembly comprising first slot panels and a first sheet, wherein ends of the first sheet are attached to the first slot panels, wherein the first sheet spans between the first slot panels, and wherein each of the first slot panels is selectively couplable to one of the first set of wing panels; and a second sheet assembly comprising second slot panels and a second sheet, wherein ends of the second sheet are attached to the second slot panels, wherein the second sheet spans between the second slot panels, and wherein each of the second slot panels is selectively couplable to one of the second set of wing panels;

wherein, after the first slot panels are coupled to the first set of wing panels, the second slot panels are coupled to the second set of wing panels, and an object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel;

wherein the first and second end panels are configured to be folded into a folded configuration;

wherein the frame further includes a first securing mechanism configured to hold the first end panel in the folded configuration with respect to the central panel and a second securing mechanism configured to hold the second end panel in the folded configuration with respect to the central panel; and wherein the first sheet assembly includes a first side panel that is fixed to a longitudinal side of the first sheet and extends beyond the longitudinal side of the first sheet, and wherein the second sheet assembly includes a second side panel that is fixed to a longitudinal side of the second sheet and extends beyond the longitudinal side of the second sheet.

13. The retention packaging assembly of claim 12, wherein:

the first side panel is configured to be folded around a first lateral side of the object after the first set of wing panels are folded to the back of the frame, the second side panel is configured to be folded around a second lateral side of the object after the second set of wing panels are folded to the back of the frame, when the first side panel is folded around the first lateral side of the object, a portion of the first side panel that is not fixed to the first sheet is between the central panel and the object, and when the second side panel is folded around the second lateral side of the object, a portion of the second side panel that is not fixed to the second sheet is between the central panel and the object.

14. A system comprising:

an object;

a retention packaging assembly, comprising:

a frame comprising:

a central panel, a first end panel foldably coupled to the central panel, a second end panel foldably coupled to the central panel, a first set of wing panels, wherein each of the first set of wing panels is foldably coupled to the central panel and to the first end panel, and a second set of wing panels, wherein each of the second set of wing panels is foldably coupled to the central panel and to the second end panel;

a first sheet assembly comprising first slot panels and a first sheet, wherein ends of the first sheet are attached to the first slot panels, wherein the first sheet spans between the first slot panels, and wherein each of the first slot panels is selectively couplable to one of the first set of wing panels; and a second sheet assembly comprising second slot panels and a second sheet, wherein ends of the second sheet are attached to the second slot panels, wherein the second sheet spans between the second slot panels, and wherein each of the second slot panels is selectively couplable to one of the second set of wing panels;

wherein, after the first slot panels are coupled to the first set of wing panels, the second slot panels are coupled to the second set of wing panels, and the object is placed on a front of the central panel, the first set of wing panels are configured to be folded to a back of the frame to cause the first sheet to retain a first side of the object to the central panel and the second set of wing panels are configured to be folded to the back of the frame to cause the second sheet to retain a second side of the object to the central panel;

wherein the first and second end panels are configured to be folded into a folded configuration; and wherein the frame further includes a first securing mechanism configured to hold the first end panel in the folded configuration with respect to the central panel and a second securing mechanism configured to hold the second end panel in the folded configuration with respect to the central panel; and a container, wherein the retention packaging assembly is configured to be placed inside the container when the object is retained to the central panel by the first and second sheets.

15. The system of claim 14, further comprising:

at least one peripheral container configured to hold one or more peripheral items.

16. The system of claim 15, wherein the peripheral container is formed from a container portion removed from one of the first and second sheet assemblies.

17. The system of claim 15, wherein the frame of the retention packaging assembly further comprises a handle panel foldably coupled to a top of the central panel.

18. The system of claim 17, wherein:

the at least one peripheral container includes a slot, the at least one peripheral container is placed in the container with a portion of the central panel inserted into the slot of the at least one peripheral container, the at least one peripheral container is located below a fold line between the central panel and the handle panel, the handle panel is configured to be folded with respect to the central panel about the fold line so that a portion of the handle panel covers an end of the at least one peripheral container, and when the handle panel is folded with respect to the central panel about the fold line, the handle panel extends across an opening of the container.

* * * * *